US007921586B2

(12) United States Patent
Reynolds, IV et al.

(10) Patent No.: US 7,921,586 B2
(45) Date of Patent: Apr. 12, 2011

(54) MULTI-SIDED ROTATABLE BILLBOARD AND ASSOCIATED METHODS

(75) Inventors: John Norton Reynolds, IV, Key Largo, FL (US); James P. Lyons, Ocoee, FL (US); Michael W. MacGeorge, Casselberry, FL (US)

(73) Assignee: AD4, LLC, Altamonte Springs, FL (US)

( * ) Notice: Subject to any disclaimer, the term of this patent is extended or adjusted under 35 U.S.C. 154(b) by 167 days.

(21) Appl. No.: 12/194,690

(22) Filed: Aug. 20, 2008

(65) Prior Publication Data

US 2009/0064550 A1 Mar. 12, 2009

Related U.S. Application Data

(63) Continuation-in-part of application No. 11/049,595, filed on Feb. 2, 2005, now Pat. No. 7,428,791.

(51) Int. Cl.
*G09F 11/02* (2006.01)

(52) U.S. Cl. ..... 40/505; 40/503; 40/475

(58) Field of Classification Search ..... 211/1.56, 211/163; 40/503–506, 468, 469, 449, 493
See application file for complete search history.

(56) References Cited

U.S. PATENT DOCUMENTS 3,755,936 A * 9/1973 Terre et al. ..... 40/473
4,761,905 A * 8/1988 Black ..... 40/447
5,692,330 A * 12/1997 Anderson, Jr. ..... 40/505
7,257,913 B2 * 8/2007 Heller et al. ..... 40/503

* cited by examiner

*Primary Examiner* — Lesley Morris
*Assistant Examiner* — Shin Kim
(74) *Attorney, Agent, or Firm* — Allen Dyer Doppelt; Milbrath & Gilchrist

(57) ABSTRACT

A display system includes a frame and a plurality of rotatable columns carried by the frame. Each of the plurality of rotatable columns may include a column connection member, at least one display engagement member carried by the column connection member, and a plurality of display members carried by the at least one display engagement member. The display system may also include a respective plurality of display guide members carried by the frame to engage each of the plurality of rotatable columns. Each of the respective plurality of display guide members may include an arcuate shaped guide. Each display guide member may have four imaginary quadrants and a portion of the arcuate shaped guide extends through each of the four imaginary quadrants. Each portion of the arcuate shaped guide extending through each of the imaginary quadrant preferably has a different shape.

48 Claims, 35 Drawing Sheets

FIG. 15A.
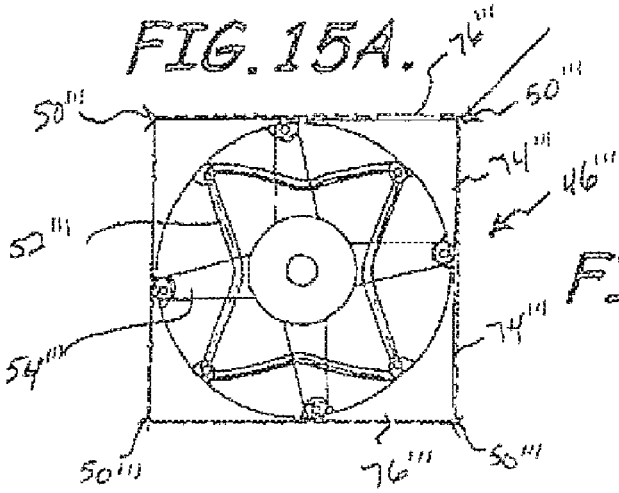
FIG. 15B.
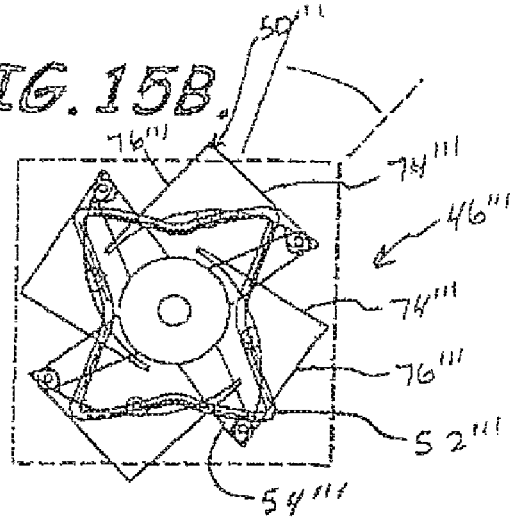
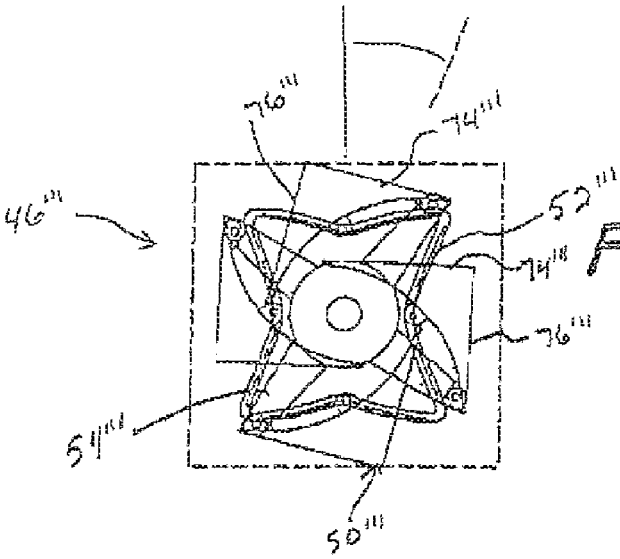
FIG. 15C.
FIG. 15D.
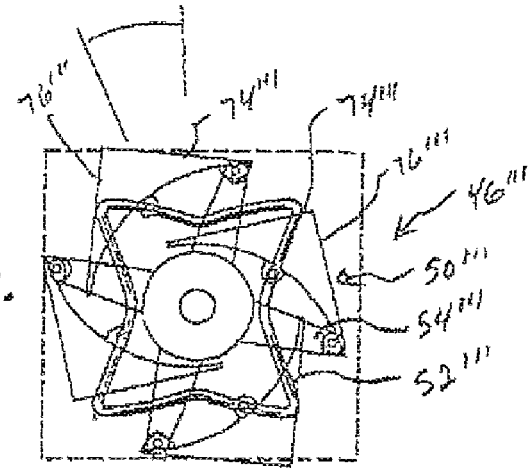
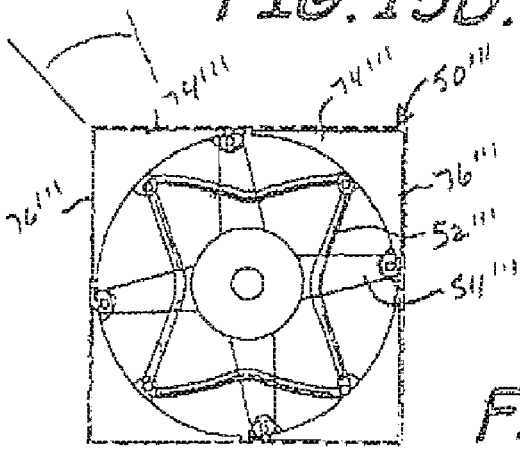
FIG. 15E.

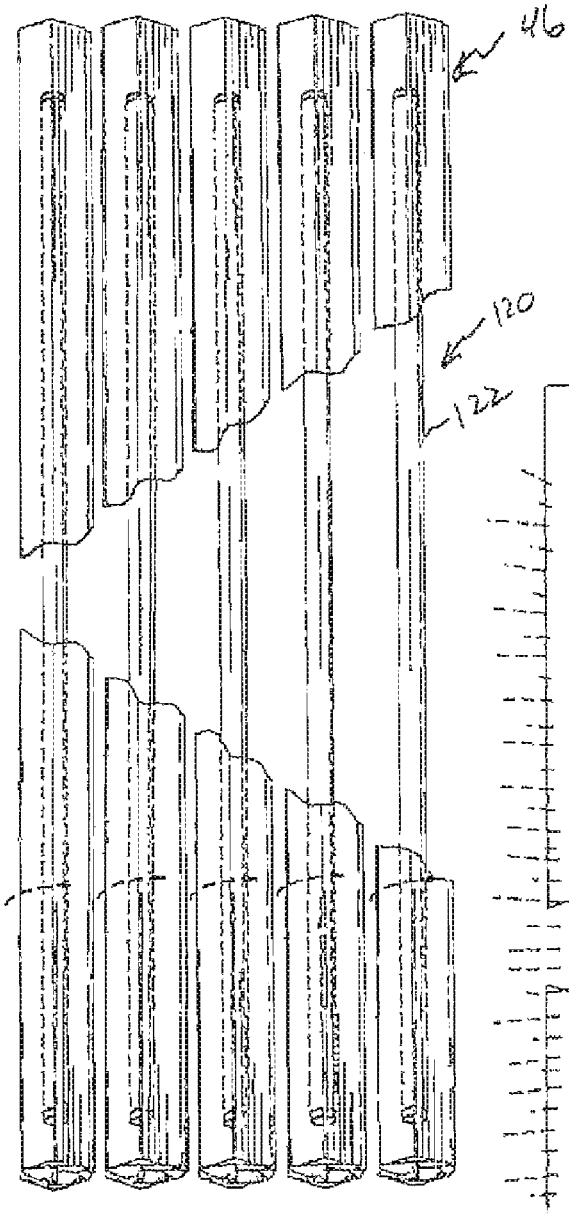
FIG. 25.
FIG. 26.
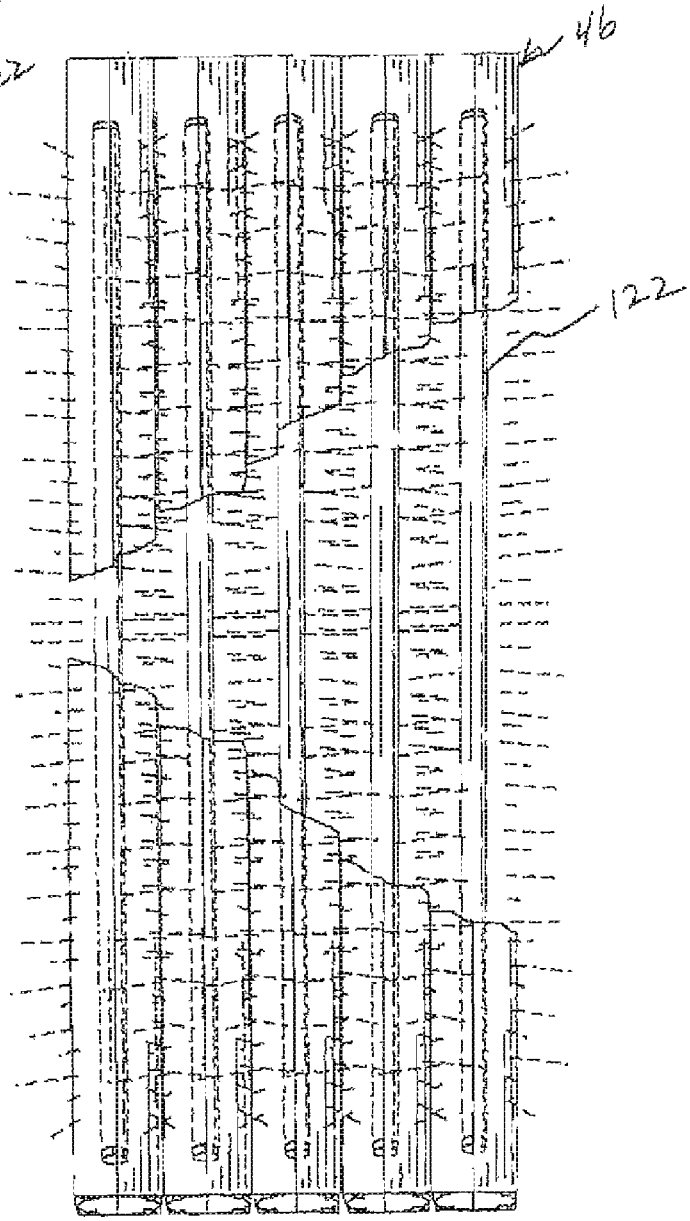

MULTI-SIDED ROTATABLE BILLBOARD AND ASSOCIATED METHODS

RELATED APPLICATIONS

This application is a continuation in part of currently pending U.S. patent application Ser. No. 11/049,595 titled Display System Having A Magnetic Drive Assembly And Associated Methods, filed on Feb. 2, 2005 which is related to related to U.S. patent application Ser. No. 11/049,596, now U.S. Pat. No. 7,093,723, titled Display System And Associated Methods, and to U.S. patent application Ser. No. 11/430,228, now U.S. Pat. No. 7,163,108, which is a divisional application of U.S. Pat. No. 7,093,723 and titled Display System And Associated Methods, by the inventors of the present application, the contents of each of which are incorporated herein by reference in their entireties.

FIELD OF THE INVENTION

The present invention relates to the field of display signs and, more particularly, to the field of rotating display signs, and related methods.

BACKGROUND OF THE INVENTION

As illustrated in FIGS. 1 and 2A-2C, rotating signs 30 are well known in the advertising industry. More particularly, rotating billboards typically include a plurality of rotating column members 32. These column members 32 typically have a triangular shape so that they may be positioned adjacent one another and simultaneously rotated without interference from one another. More particularly, the column members 32 may be moved between first, second and third positions. FIG. 2A illustrates a column member 32 positioned in a first position, according to the prior art. FIG. 2B illustrates a column member 32 being moved between the first position, as illustrated in FIG. 2A, and a second position, as illustrated in FIG. 2C. The triangular shape of the column members 32 allows for three different advertisements to be positioned on a single billboard.

Although triangular shaped column members 32 provide rotatable billboards with the ability to display three messages, there are still several problems with existing three message display systems. For example, typical three message display systems rotate each of the plurality of column members simultaneously. Further, each of the plurality of column members are generally in mechanical communication with one another during rotation. Accordingly, when one column member fails, or remains stationary for some reason, the adjacent columns rotation pattern is interfered with, causing an eventual failure of the entire display.

U.S. Pat. No. 3,921,321 to Weisskopf discloses a sign including a plurality of rotatable column members. More specifically, the rotatable column members have a triangular shape, and each of the column members are rotated in a circular path. Accordingly, a plurality of triangularly shaped column members may be positioned adjacent one another and still rotate in a circular path without interfering with one another. This is generally the case, however, only when the column members are rotated simultaneously, or with a very slight delay. Each of the triangularly shaped column members are connected to a chain drive assembly. Movement of the chain drive assembly causes rotation of the triangularly shaped column members. Accordingly, up to three different signs, or advertisements, may be displayed on the sign.

Accordingly, a rotating billboard having triangularly shaped column members may advantageously allow simultaneous rotation of the column members while positioned adjacent one another. Of course, increasing the number of advertisements carried by a billboard may advantageously increase advertising revenue. Unfortunately, however, billboards having triangularly shaped column members are limited to displaying three advertisements. To increase the number of advertisements displayed on the billboard may require the use of a plurality of four-sided column members. Four-sided column members, however, positioned adjacent one another could not rotate in a circular path without substantial interference.

In an attempt to solve this problem, U.S. Pat. No. 1,650,205 to Grower et al. discloses a billboard system having a plurality of four-sided column members that are spaced-apart and separated by structural frame member. Each of the column members have a plurality of panels, and the column members may be individually rotated. More specifically, one panel may be displaced in a predetermined direction to decrease the size of the column member so that an adjacent column member may rotate. In other words, one of the sides of the four-sided column member may be inwardly displaced to make room for an adjacent column member to rotate.

Another attempt to provide a display system having a rotatable four-sided column is disclosed in U.S. Pat. No. 1,362,542 to Rogers. Each column member includes four display members, and a pair of opposing curved guided walls for aligning the display members on each column member as they are rotated to a display position. The curved guide walls also act to initially pivot each display member approximately 60 degrees to allow the column member to rotate from a first display position to a second display position. This type of display system, however, is limited to displaying only two different displays.

Yet another attempt to provide a display system having a plurality of four-sided column members is disclosed in U.S. Pat. No. 1,112,921 to La Pearl. The four-sided column members in the La Pearl '921 patent are spaced-apart to facilitate rotation along a substantially circular path without interference with one another. More specifically, the sign includes a plurality of leafs to fill in the spaces between the rotating column members to provide the appearance of a continuous front display face.

There exist several different types of drive assemblies to rotate column members of a display system. For example, the Weisskopf '321 patent, discussed above, discloses a chain drive assembly to rotate column members. U.S. Pat. No. 5,572,816 to Anderson, Jr. et al. discloses a rotating sign having a cylindrical shape and a plurality of elongate louvers that rotate as the sign rotates. Rotation of each of the louvers may be accomplished using a chain drive assembly.

Another type of drive assembly for rotating an object is disclosed in U.S. Pat. No. 4,521,983 to Wakatake. More specifically, the drive assembly is a magnetic motor mechanism to rotate a sign 90 and/or 180-degrees. The magnetic motor includes four poles having an arcuate shape to allow for 90 and/or 180-degree rotation of the object.

SUMMARY OF THE INVENTION

With the foregoing in mind, it is therefore an object of the present invention to provide a display system having enhanced display surfaces to advantageously increase advertising revenue. It is also an object of the present invention to provide a display system that allows four-sided rotatable columns to simultaneously rotate when positioned adjacent one another.

It is further an object of the present invention to provide a display system having rotatable columns that may be smoothly rotated through a predetermined number of display positions. It is still further an object of the present invention to provide a display system that may advantageously be programmed with various rotational patterns.

It is yet another object of the present invention to provide a display system that may be remotely operated. It is also an object of the present invention to provide display system that has decreased maintenance costs and enhanced reliability.

It is still another object of the present invention to provide a display system that allows the plurality of columns to independently rotate, rotate with delays, and rotate in various sequences to advantageously allow for an infinite number of rotations sequences.

These and other objects, features and advantages in accordance with the present invention are provided by a display system comprising a frame, and a plurality of rotatable columns carried by the frame. Each of the plurality of rotatable columns may include a column connection member, a display engagement member carried by the column connection member, and a plurality of display members carried by the display engagement member.

The display system may also include a respective plurality of display guide members carried by the frame to engage each of the plurality of rotatable columns. Each of the respective plurality of display guide members may include an arcuate shaped guide. Further, the display guide member may have four imaginary quadrants and a portion of the arcuate shaped guide may extend through each of the four imaginary quadrants. More particularly, each portion of the arcuate shaped guide extending through each of the imaginary quadrant preferably has a different shape.

The arcuate shaped guide may be defined by an arcuate shaped slot formed in each of the plurality of display guide members. Each of the plurality of display members may include a pin member extending from a top or bottom portion thereof to engage the display engagement member.

The display system may include a pair of display engagement members. More particularly, the pair of display engagement members may include a first display engagement member carried by an upper portion of the column connection member and a second display engagement member carried by a lower portion of the column connection member. Multiple display engagement members advantageously enhance stability of the display system.

Each of the plurality of display members may comprise at least one guide engagement member to engage the arcuate shaped guide. Further, each of the plurality of rotatable columns may be four-sided rotatable columns. The plurality of display members may comprise four display members. Accordingly, each of the rotatable columns may rotate between first, second, third and fourth positions. Further, each of the columns may be rotated in any direction, i.e., clockwise or counterclockwise. Each of the rotatable columns preferably rotate 90 degrees to move between the first, second, third and fourth positions. The four display faces of the display system according to the present invention advantageously enhance the number of displays that can be shown on one sign.

The display system may also comprise a respective plurality of drives for rotating each of the respective plurality of rotatable columns. Each of the respective plurality of rotatable columns may comprise at least one drive associated therewith. Individual drives for each of the columns advantageously decrease maintenance associated with the display system.

The display system may also include a controller in communication with each of the respective plurality of drives. Accordingly, each of the plurality of drives are in communication with one another. This advantageously allows the plurality of columns to be rotated in any number of different patterns. Further, this configuration also advantageously allows for a column that may have rotated out of place to be readily identified and rotated back into position. Each of the drives are preferably variable speed drives.

Each of the display guide members may include a tool receiving recess formed therein. The tool receiving recess is shaped to receive a tool to maintain a position of each of the respective plurality of rotatable columns. This is especially advantageous when installing or removing a display member, and also for routine maintenance needs.

Each of the display members may include media fastening members. The media fastening members may include a base media fastening member, a top media fastening member and a pair of opposing side media fastening members. The media fastening members advantageously decrease costs associated with positioning indicia on the display system.

The display system may also comprise column position sensors associated with the rotatable columns. The column position sensors are preferably positioned in communication with the controller. Each of the column position sensors may include a column position disk carried by the column connection member and a column position magnet in communication with the column position disk. The column position disk may include a plurality of column position indicators to indicate a position of each of the rotatable columns.

Each of the column position magnets may be in communication with the controller to transmit a position of each of the plurality of rotatable columns based on a sensed position of the plurality of column position indicators. The column position sensors advantageously allow the position of each of the plurality of columns to be readily ascertained. The column position sensors also advantageously allow for each of the columns to be readily moved to a desired position based on a sensed position.

A method aspect of the present invention is for displaying indicia. The method may include positioning the indicia on a plurality of rotatable columns carried by a frame. The method may also include engaging the respective plurality of rotatable columns to a respective plurality of display guide members carried by the frame, and rotating the rotatable columns having the indicia positioned thereon.

BRIEF DESCRIPTION OF THE DRAWINGS

FIGS. 15A-15E are top plan views of the column member shown in FIG. 13 being moved between first, second, third and/or fourth positions.

FIG. 25 is a partial perspective view of a plurality of column members of a display system according to the present invention including an illumination source and in an off position.

FIG. 26 is a partial perspective view of the plurality of column members shown in FIG. 25 with the illumination source in an on position.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notations are used to indicate similar elements in alternate embodiments.

Referring initially to FIGS. 3 and 4A-4C, a display system 40 in accordance with the present invention is now described in detail. The display system 40 includes a frame 42, a plurality of column connection members 44 that are connected to the frame, and a plurality of four-sided column members 46 that are positioned adjacent one another and rotatably connected to the respective column connection members.

Figure 1:
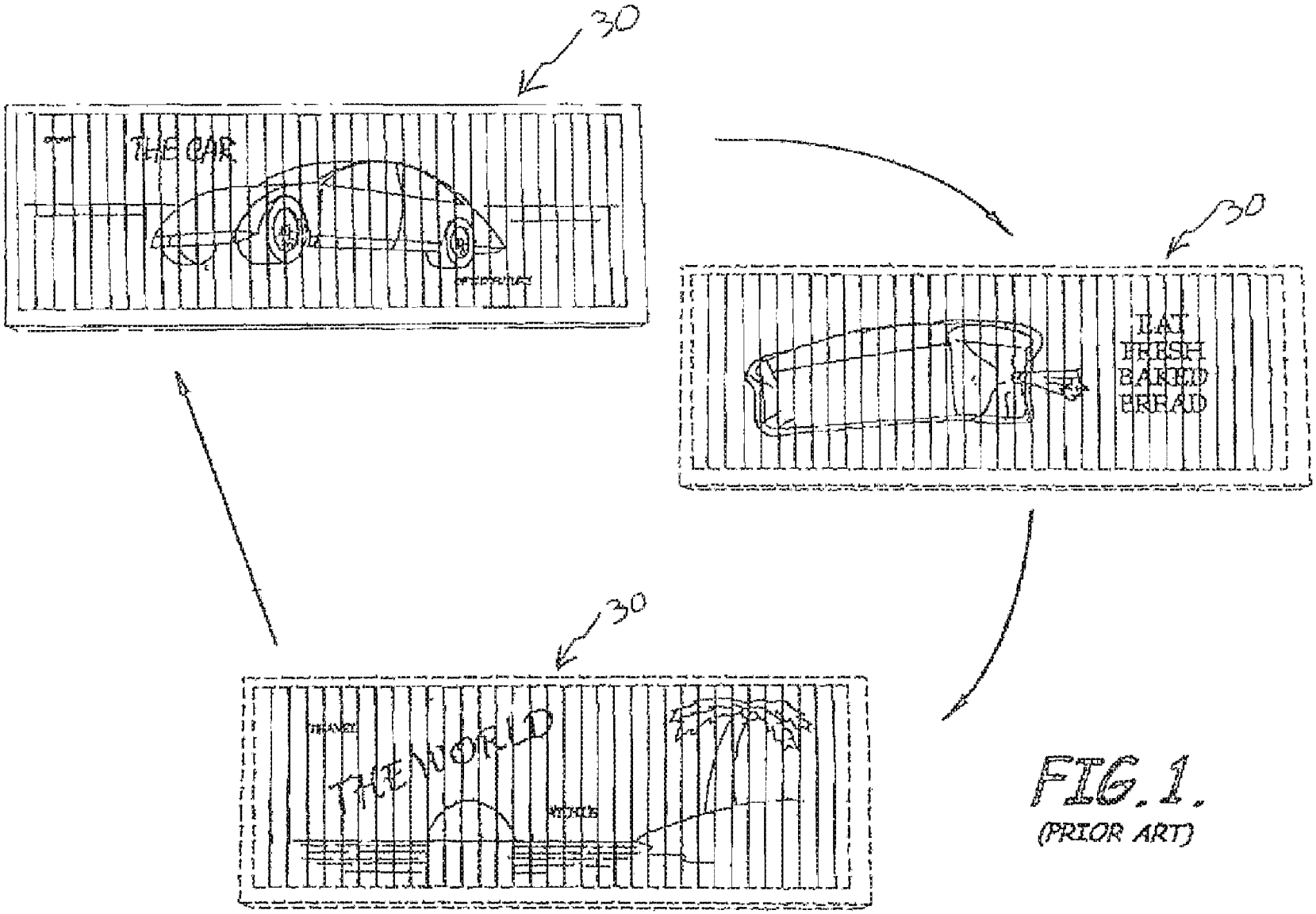
FIG. 1. (PRIOR ART)
FIG. 1 is a front perspective view of a display system according to the prior art.
Figure 2A:
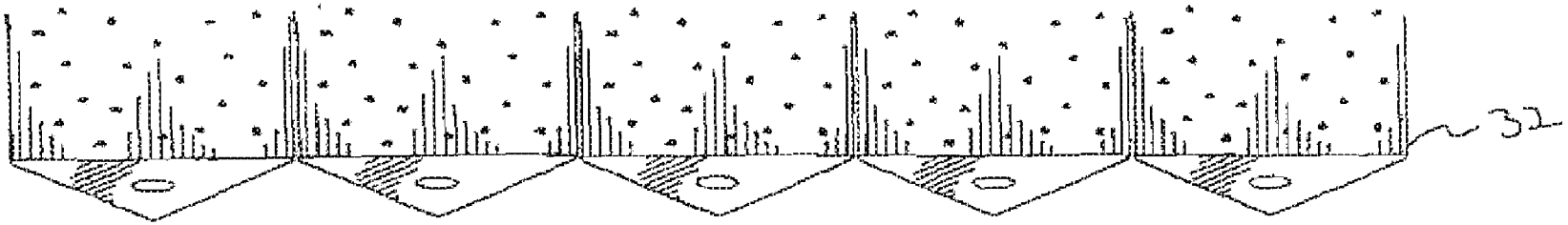
FIG. 2A. (PRIOR ART)
FIGS. 2A-2C are partial perspective views of column members of the display system illustrated in FIG. 1 according to the prior art.
Figure 2B:
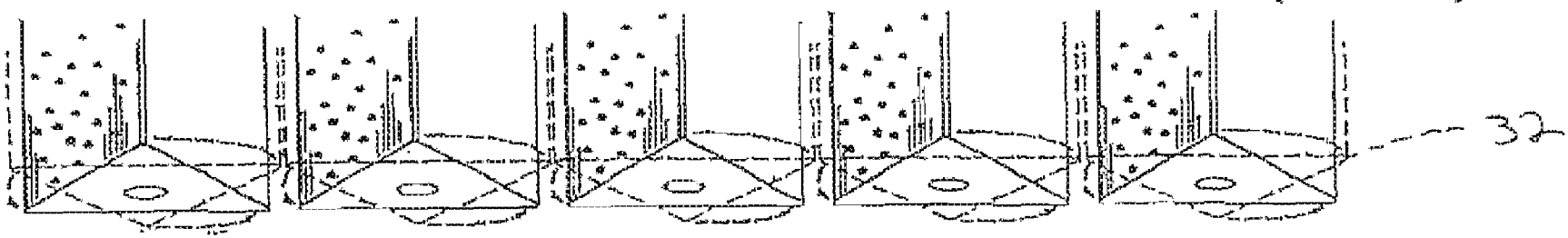
FIG. 2B (PRIOR ART)
Figure 2C:
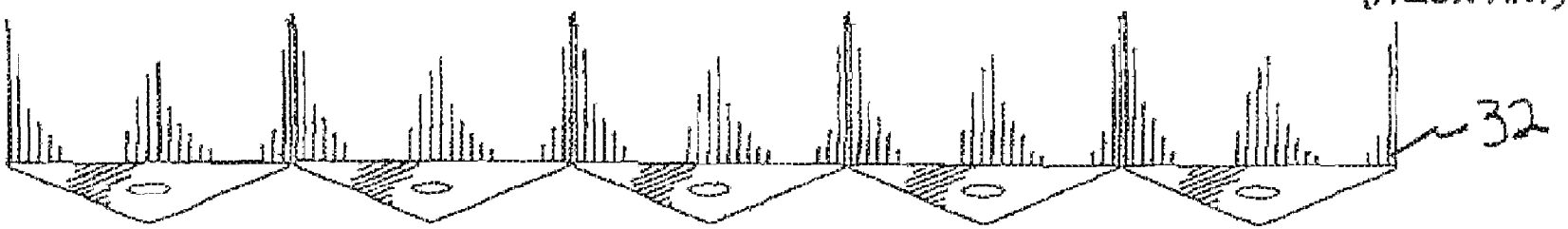
FIG. 2C. (PRIOR ART)
Figure 3:
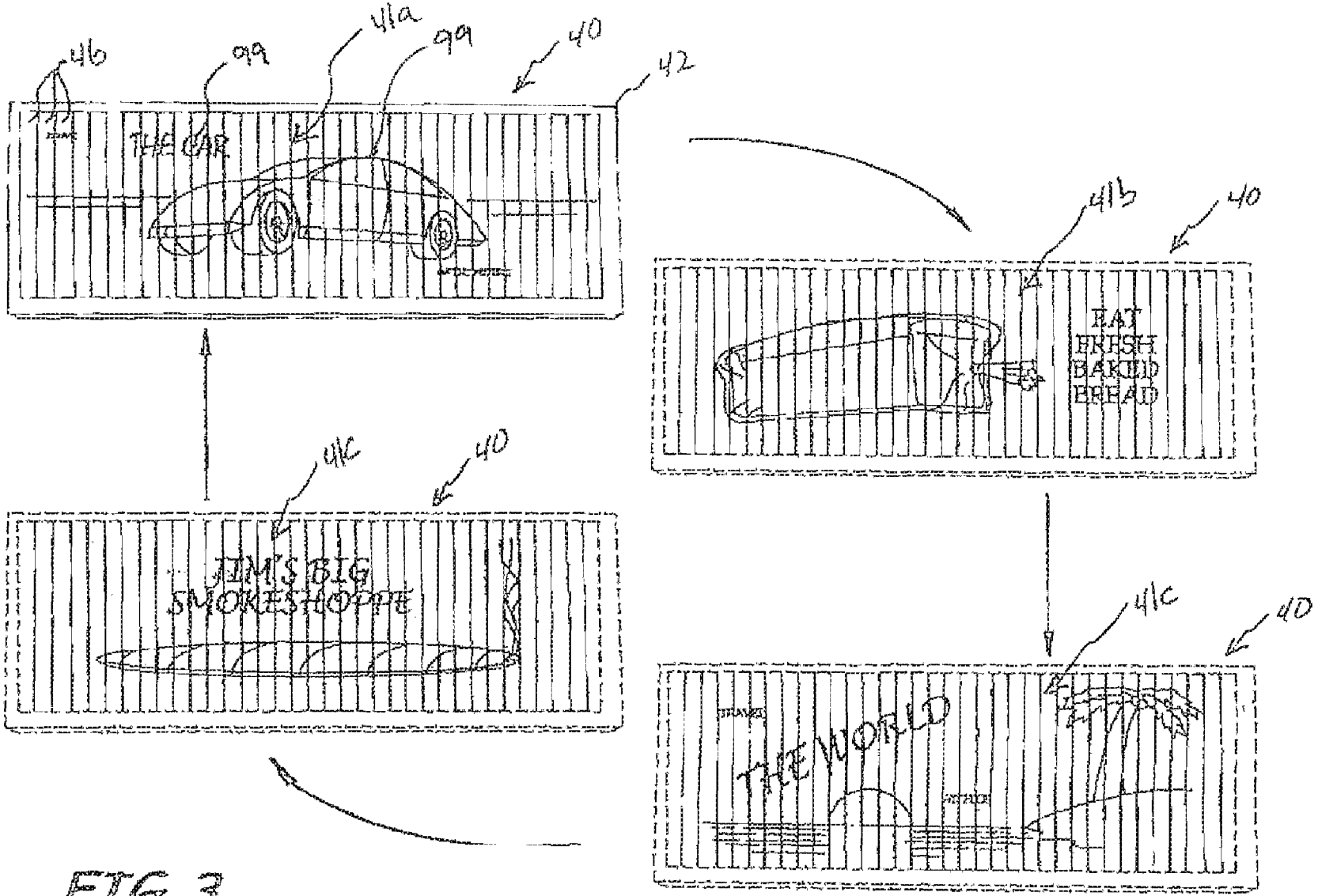
FIG. 3 is a front perspective view of a display system according to the present invention.

Accordingly, and as perhaps best illustrated in FIG. 3, the display system 40 of the present invention advantageously allows enhanced display of multiple signs 41*a*, 41*b*, 41*c*, 41*d*.

More specifically, the display system 40 of the present invention advantageously allows four signs 41, which may include advertising indicia 99, for example, to be individually displayed based on rotation of the four-sided column members 46. Enhanced display of advertising indicia 99 on the multiple signs 41 carried by the display system 40 of the present invention advantageously enhances revenue that may be generated from displaying the signs.

Figure 5:
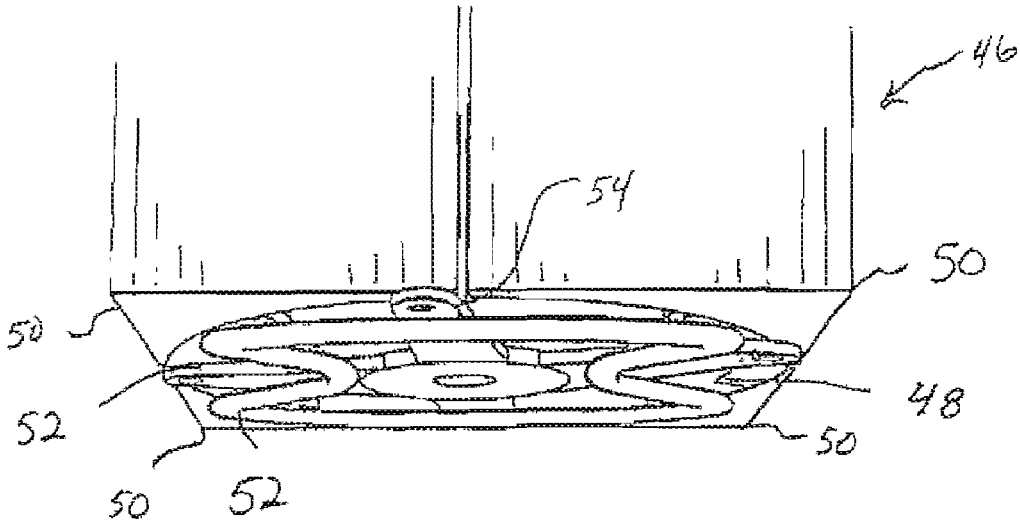
FIG. 5 is a partial perspective view of one of the column members illustrated in FIG. 4 showing a display engagement member and a display guide.
Figure 6:
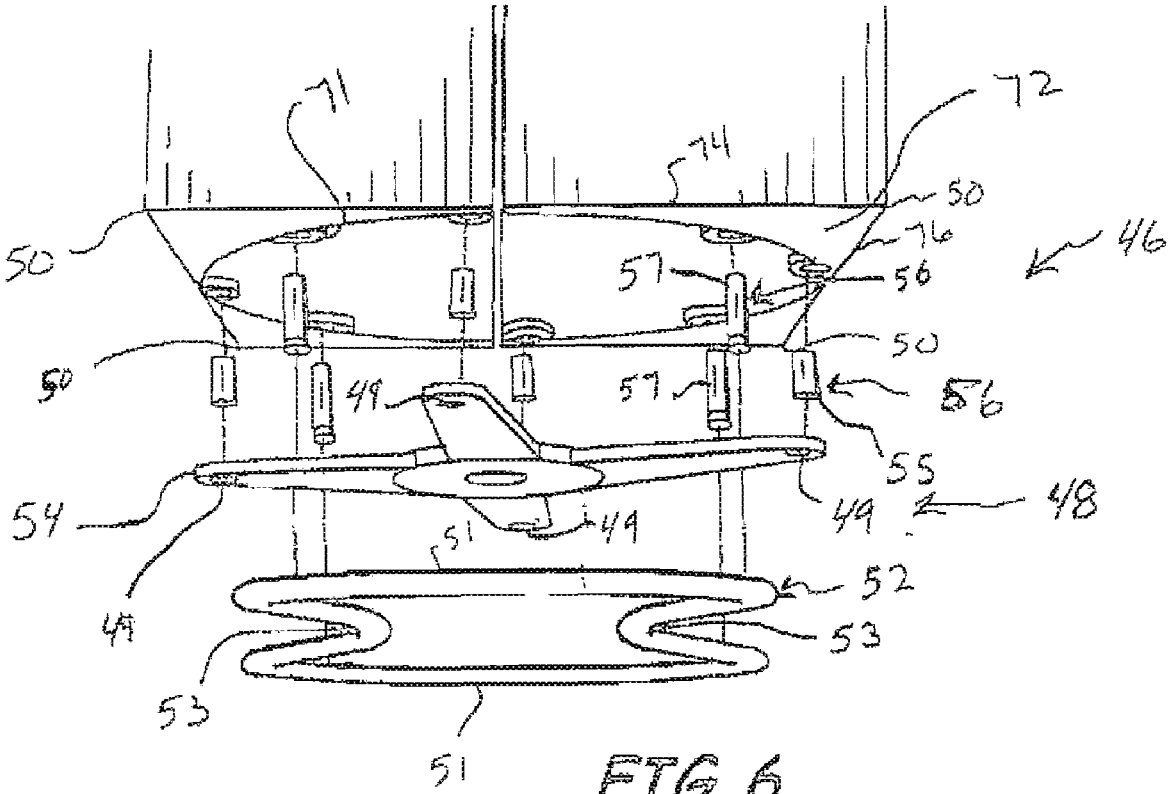
FIG. 6 is an exploded partial perspective view of the column member illustrated in FIG. 5.

Referring now additionally to FIGS. 5 and 6, the column members 46 are now described in detail. Each column member 46 may include a connector 48. The column members 46 may also include elongate display members 50 positioned adjacent one another and pivotally connected to the connector 48.

The connector 48 may illustratively include a display guide 52, a display engagement member 54, and a plurality of pin members 56 for connecting the display members to the display engagement member. The pin members 56 may also engage the display engagement member 54 with the display guide 52.

Figure 4A:
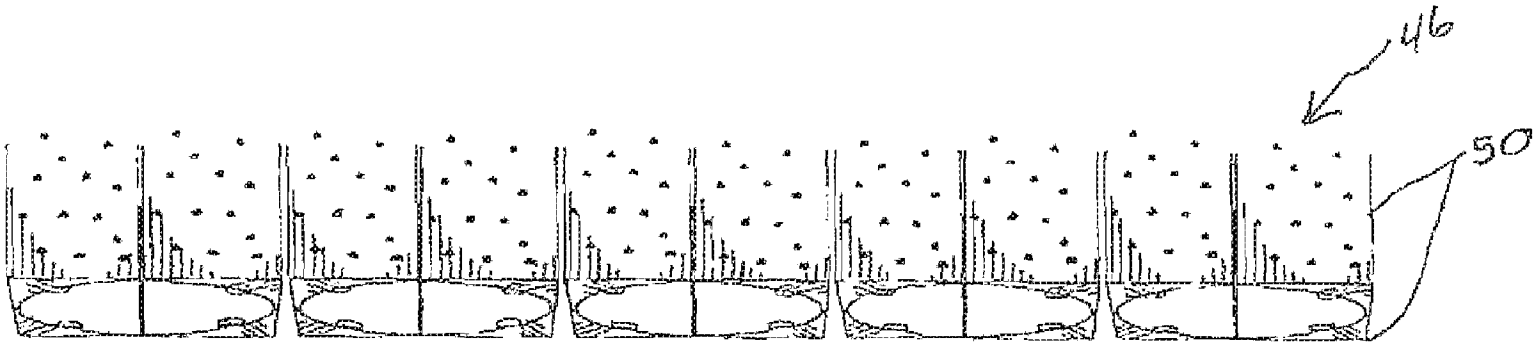
FIGS. 4A-4C are partial perspective views of four-sided column members of the display system illustrated in FIG. 3.
Figure 4B:
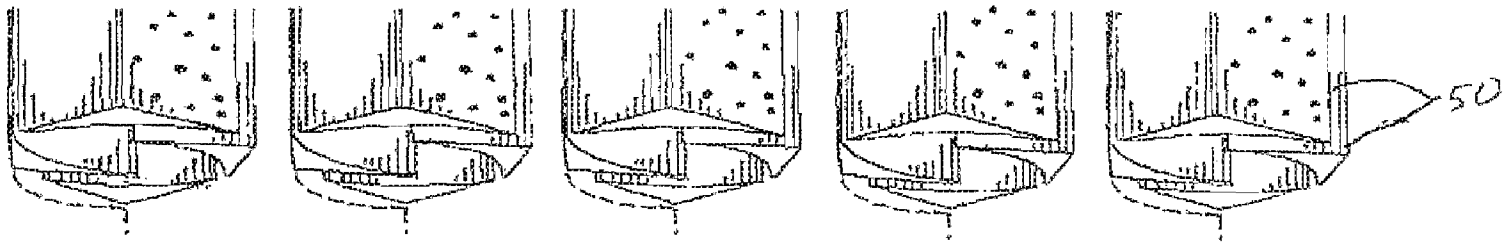
Figure 4C:
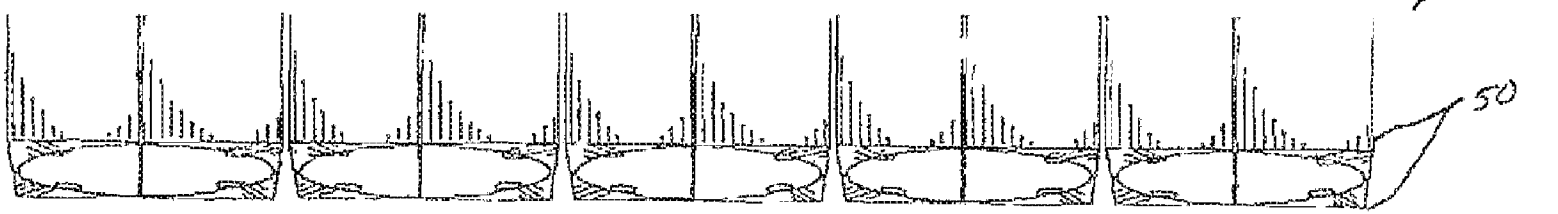

As perhaps best illustrated in FIGS. 4A-4C, the display members 50 may be pivoted in predetermined directions to rotate the column members 46. As will be discussed in greater detail below, the pivoting of the display members 50 changes the shape of the column members 46 to allow rotation of a plurality of four-sided column members positioned adjacent one another. More specifically, the column members 46 may be rotated between first, second, third and fourth positions.

In FIG. 4A, the column members 46 are positioned in a first position. FIG. 4B illustrates the column members 46 being rotated between the first position, illustrated in FIG. 4A, and the second position, illustrated in FIG. 4C. The display members 50 are pivoted in a predetermined direction in FIG. 4B to rotate the plurality of column members 46 when positioned adjacent one another. Although a plurality of column members 46 are illustrated in FIGS. 4A-4C, numbers are used to refer to elements of only one column member for simplicity.

Figure 16:
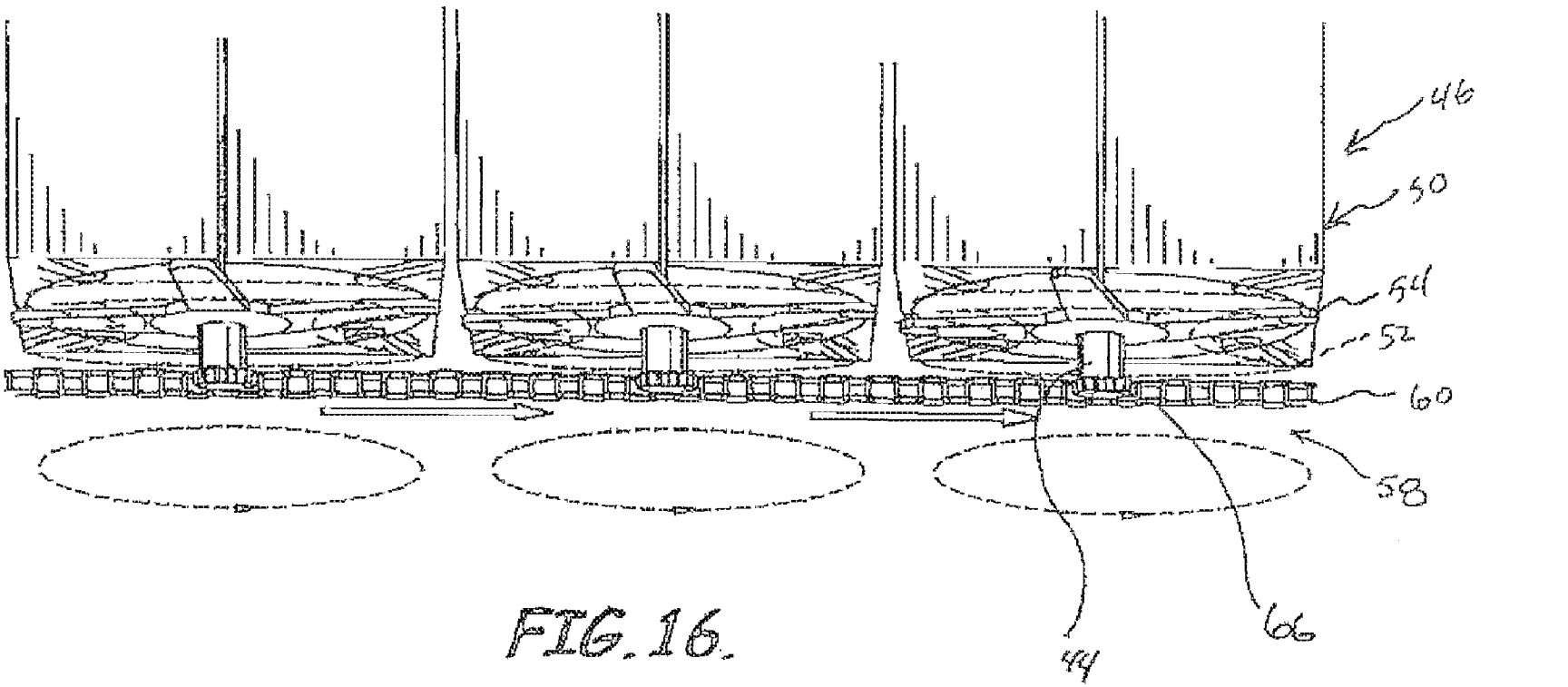
FIG. 16 is a partial perspective view of a plurality of column members positioned adjacent one another and engaging a drive assembly according to the present invention.
Figure 17:
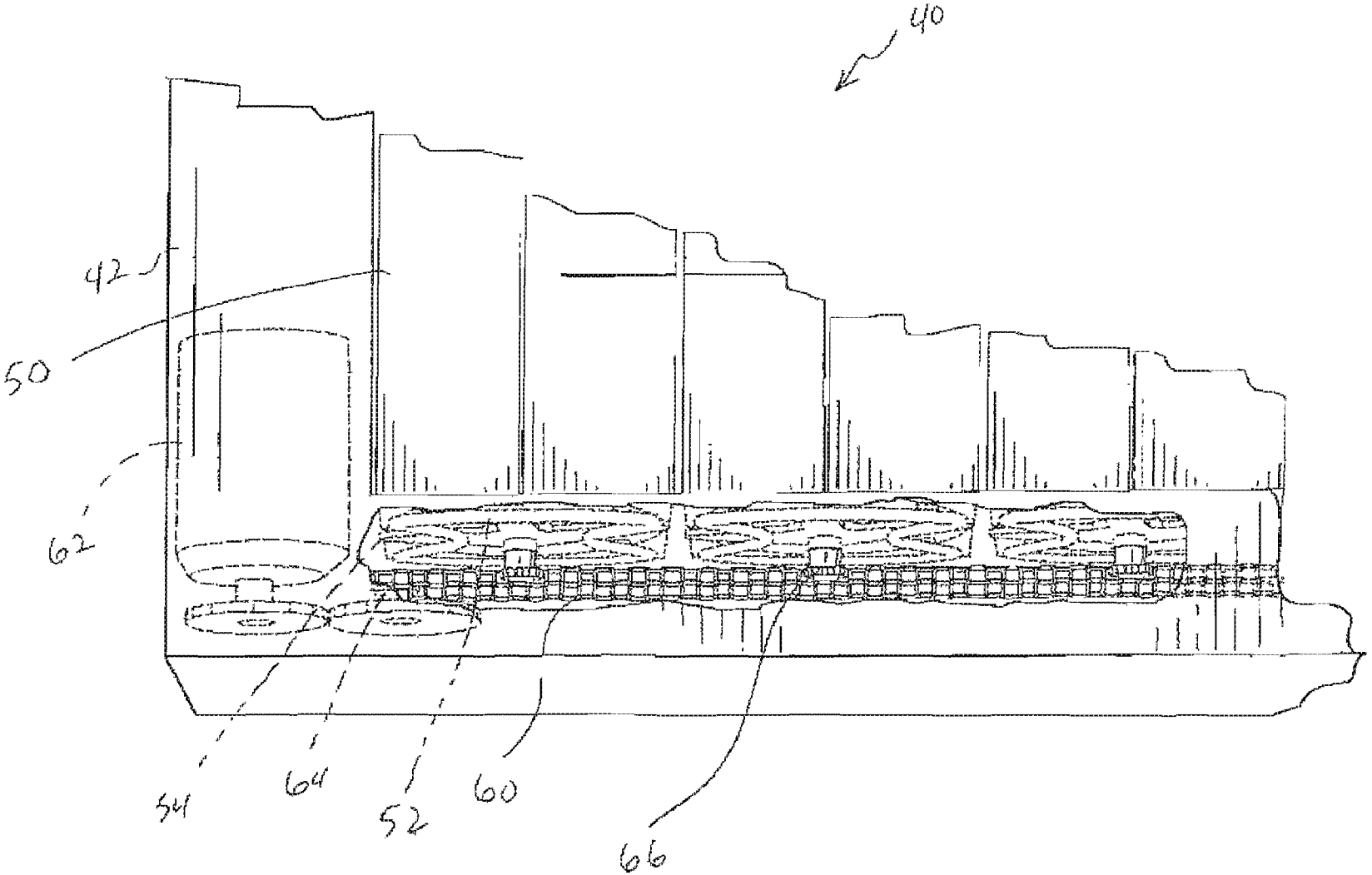
FIG. 17 is a partial perspective view of the column members illustrated in FIG. 16 connected to the drive assembly and carried by the frame.

As illustrated in FIGS. 16 and 17, the display system 40 may also include a drive assembly 58 carried by the frame 42. The drive assembly 58 may engage the column connection members 44 to rotate each column member 46. More specifically, the drive assembly 58 may engage the column connection members 44 so that selected display members 50 may pivot in the predetermined direction, as illustrated in FIGS. 4A-4C, responsive to operation of the drive assembly during rotation of the column members 46 to change the shape of the column members.

The drive assembly 58 illustrated in FIGS. 16 and 17 may be a chain drive assembly. The chain drive assembly 58 may include a chain 60 and a motor 62 carried by the frame 42. The chain drive assembly 58 may also include a first chain engaging member 64 connected to the motor 62 for engaging a portion of the chain 60. The first chain engaging member 64 and the second chain engaging member (not shown) may, for example, be provided by a gear, sprocket, or any other similar member suitable for engaging the chain 60, as understood by those skilled in the art.

The chain drive assembly 58 may also include a second chain engaging member that is spaced-apart from the first chain engaging member 64 for engaging another portion of the chain 60. The chain drive assembly 58 may also include a drive assembly connection member 66 connected to the column connection members 44 to engage the chain 60 so that each column member 46 may rotate responsive to movement of the chain 60. The drive assembly connection member 66 may also be a gear or sprocket, for example, or any other similar member suitable for engaging the chain 60 to cause rotation of the column members 46. Although the drive assembly 58 is illustrated in a chain drive assembly, those skilled in the art will appreciate that the drive assembly may also be provided by a cable drive assembly, or any other type of drive assembly using a looped member that engages members on the column connection members 44 so that movement of the looped member will cause rotation of the column members 46.

Referring now back to FIGS. 5 and 6, aspects of a first embodiment of the display guide 52 and display engagement member 54 are now described in greater detail. The display guide 52 may have an hourglass shape. The hourglass shape may be defined by convex front and rear portions 51 and concave side portions 53. The display engagement member 54 may have a star shape defined by a medial portion and a plurality of arm portions extending outwardly therefrom. Passageways 49 may be formed in ends of the arm portions for receiving the pin members 56. Both the display guide 52 and the display engagement member 54 may, for example, be made of a metal material, plastic material, composite material, or any other type of material having high strength properties, as understood by those skilled in the art.

As illustrated in FIGS. 7A-7E, in this embodiment, the plurality of display members 50 may be defined by pairs of opposing display members. More specifically, a first one of the pairs of display members 68 may pivot inwardly when adjacent the concave side portions 53 of the display guide 52 as each column member 46 rotates. A second pair of the display members 70 may travel along a substantially circular path adjacent the convex front and rear portions 51 of the display guide 52 when the column members 46 rotate.

Figure 7A:
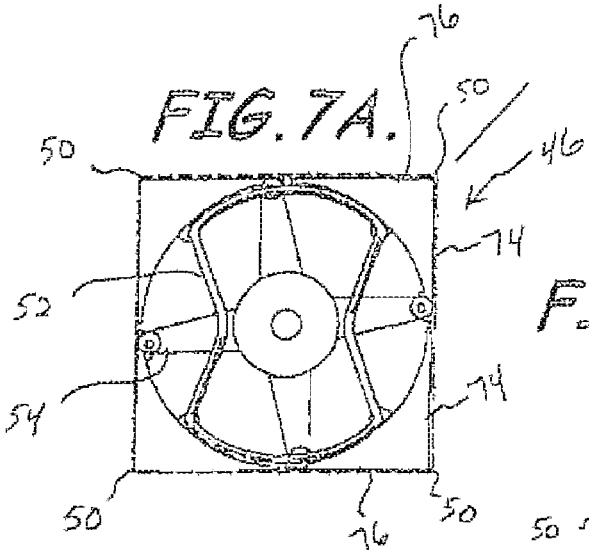
FIGS. 7A-7E are top plan views of the column members shown in FIG. 5 being rotated between first, second, third and fourth positions.
Figure 7B:
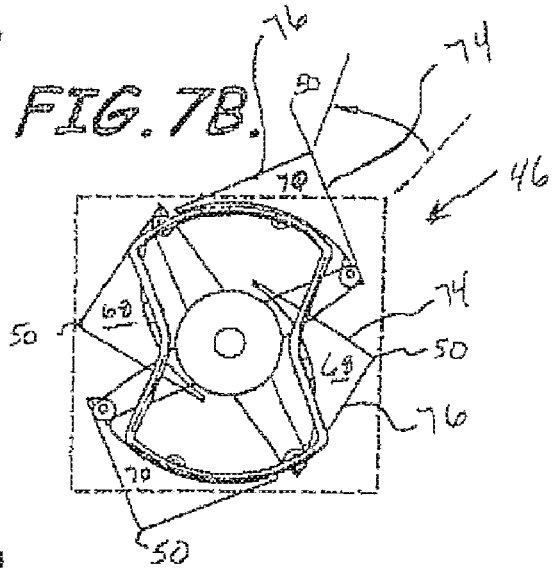
Figure 7C:
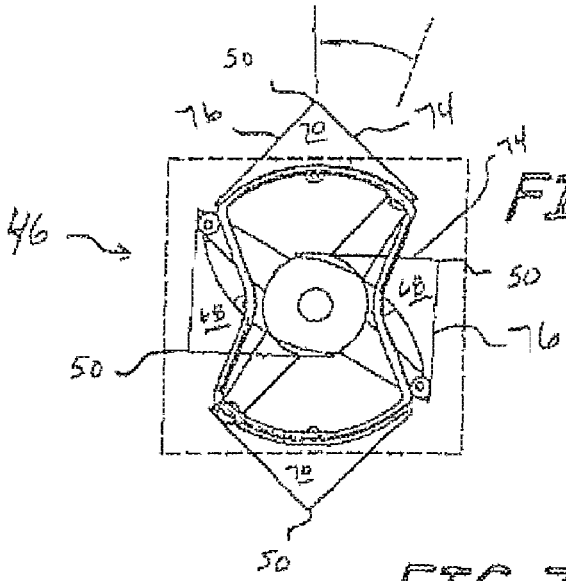
Figure 7D:
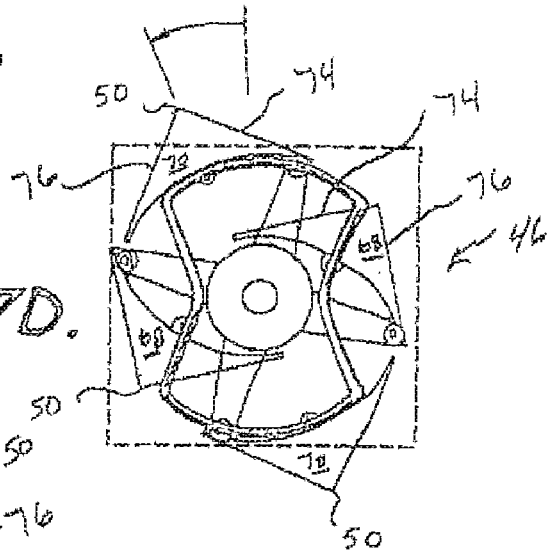
Figure 7E:
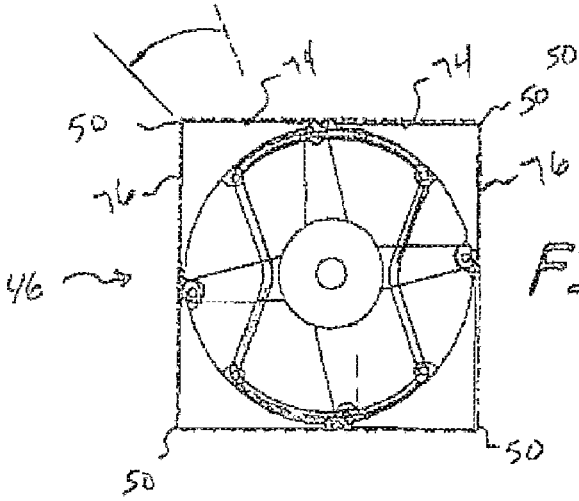

FIGS. 7A-7E illustrate rotation of a column member 46 when using the hourglass shaped display guide 52. The column member 46 illustrated in FIG. 7A is in a first position. The column member 46 illustrated in FIG. 7E is in a second position. FIGS. 7B-7D illustrate the movement of the column member 46 from the first position to the second position. More specifically, the first pair of opposing display members 68 pivot inwardly when adjacent the concave side portions 53 of the display guide 52, and the second pair of display members 70 travel along a substantially circular path adjacent the convex front and rear portions 51 of the display guide 52 when the column member 46 rotates.

Accordingly, the shape of the column member 46 may be changed during rotation to allow a plurality of column members positioned adjacent one another to rotate simultaneously. In other words, and as illustrated in FIGS. 7A and 7E, the general shape of the column members 46 is preferably square. In order for a plurality of square shaped column members to rotate adjacent one another, the shape is changed, as illustrated in FIGS. 7B-7D, so that the column members 46 may rotate without interference from one another.

Figure 8:
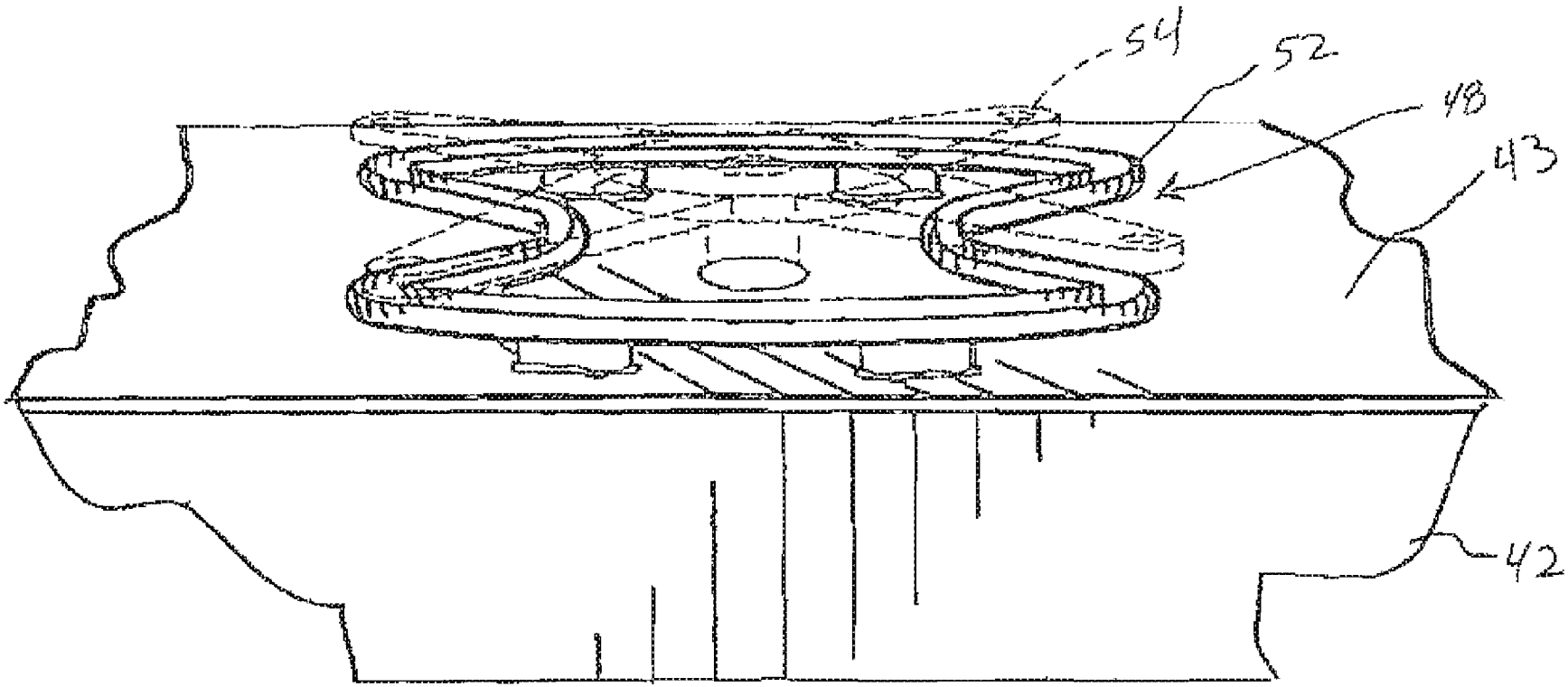
FIG. 8 is a partial perspective view of a display guide connected to a frame of the display system.

As illustrated in FIG. 8, the display guide 52 may be a track. Further, the pin members 56 may comprise track engagement pin members 57 and display engagement pin member 55. More specifically, the track engagement pin members 57 may engage the display guide track 52 to pivot the display members 50 in a predetermined direction. The display engagement pin members 55 may engage the display members 50 with the display engagement member 54 to thereby connect the display members to a display engagement member. The pin members 56 are preferably made of high strength material, such as a metal or a composite, for example, or any other type of high strength material as understood by those skilled in the art.

The display guide track 52 may be mounted to a display base 43. The display base 43 is preferably carried by the frame 42. The display guide track 52 may be connected to the display base 43 using any one of a number of different types of connections. For example, the display guide track 52 may be mounted to the display base 43 using mechanical connectors, e.g., screws. The display guide track 52 may also be mounted to the display base 43 using other connections, such as a welded connection, for example, or any other type of connection as understood by those skilled in the art. Further, those skilled in the art will appreciate that the display guide track 52 and the display base 43 may be integrally formed as a monolithic unit.

Figure 9:
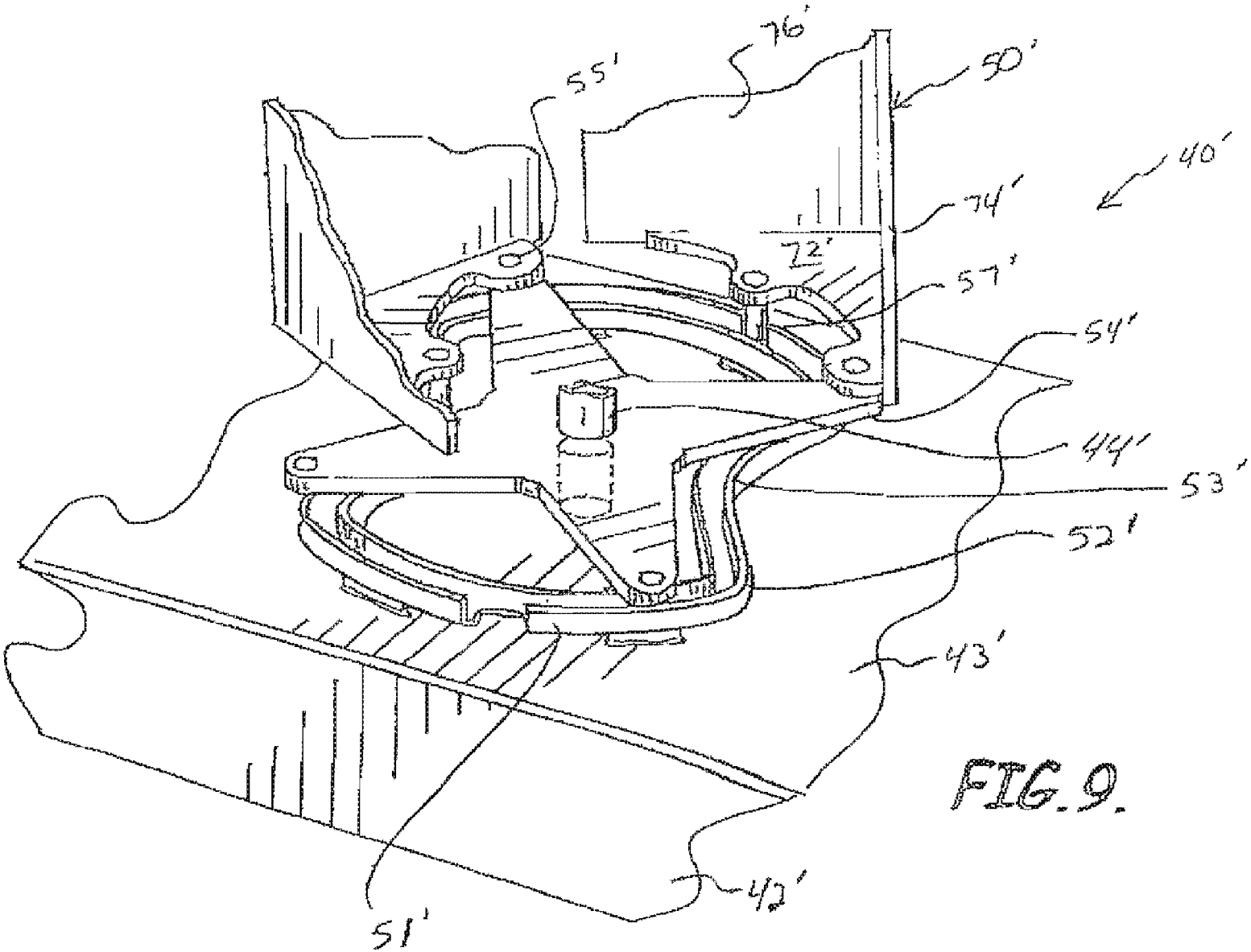
FIG. 9 is a partial perspective view of a column member connected to the display guide illustrated in FIG. 8.
Figure 10:
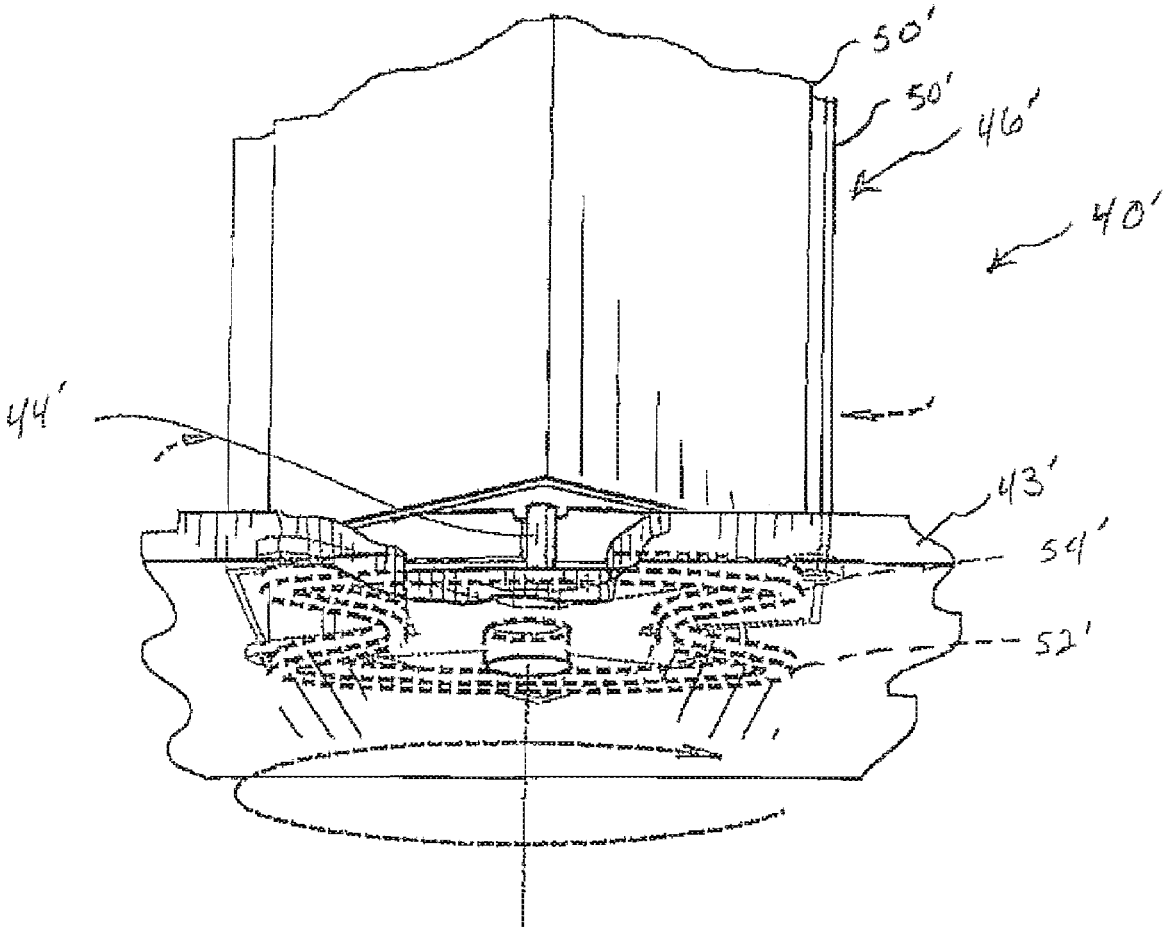
FIG. 10 is a partial perspective view of a column member connected to the display guide illustrated in FIG. 8 and being moved between any one of the first, second, third and fourth positions.

Another embodiment of the display guide track 52' is illustrated in FIGS. 9 and 10. The display guide track 52' illustrated in FIGS. 9 and 10 is mounted to the display guide base 43', and preferably has a U-shape. When using this embodiment of the display guide 52', the track engagement pin members 57' engages an interior section of the U-shaped portion of the display guide track. The display engagement pin members 55' connect the display members 50' to the display engagement member 54'. The other elements of this embodiment of the invention are similar to those of the first embodiment of the invention, are labeled with prime notation and require no further discussion herein.

Figure 12:
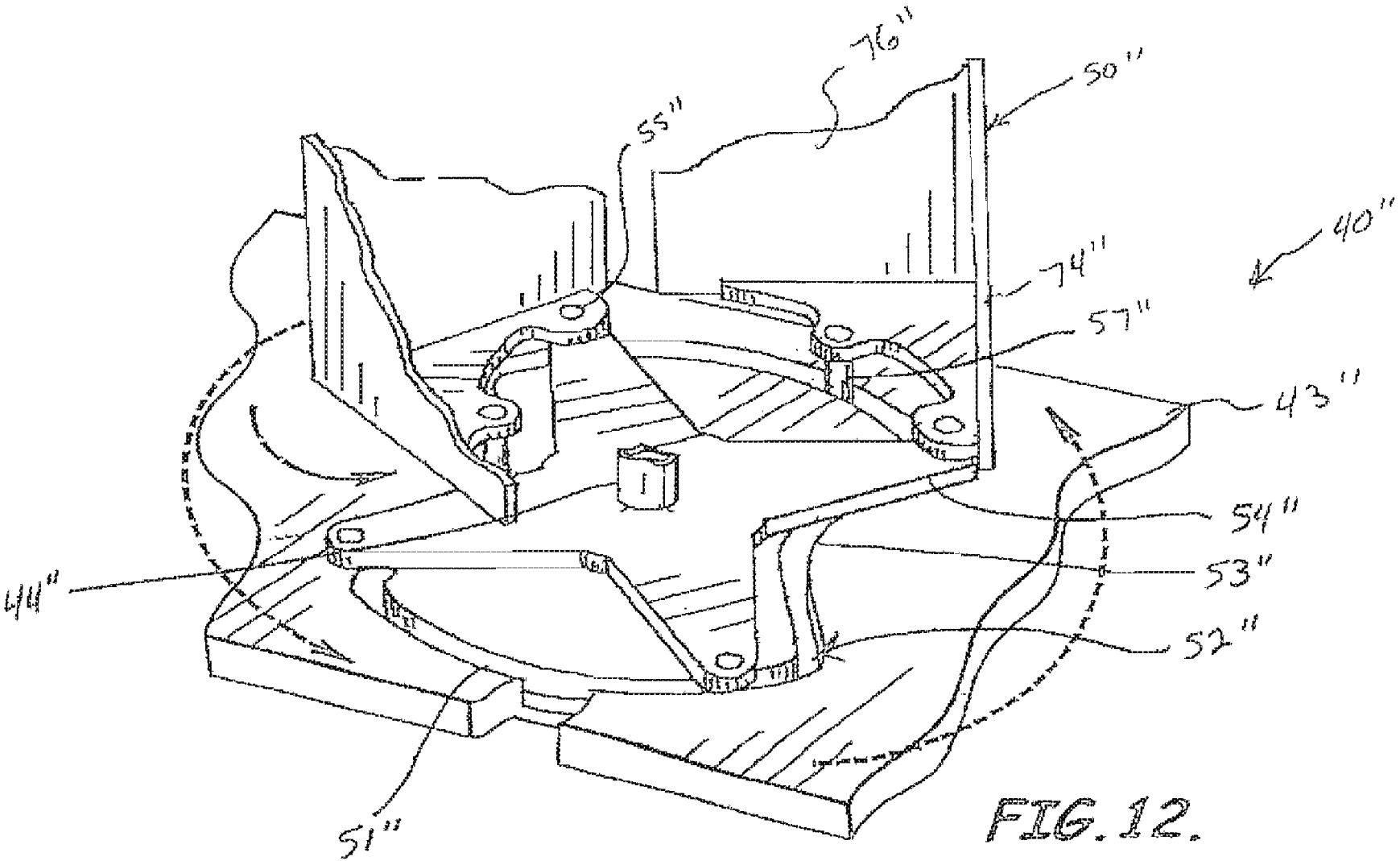
FIG. 12 is a perspective view of a column member connected to another embodiment of the display guide according to the present invention.

Referring now additionally to FIG. 12, yet another embodiment of the display guide 52" is described in greater detail. In this embodiment, the display guide 52" is provided by a slot formed in the display guide base 43". The track engagement pin members 57" engage the slot 52" to pivot the display members 50" in the predetermined direction as the column member 46" rotates. The other elements of this embodiment of the invention are similar to the element of the first embodiment, are labeled with double prime notation, and require no further discussion herein.

Figure 11:
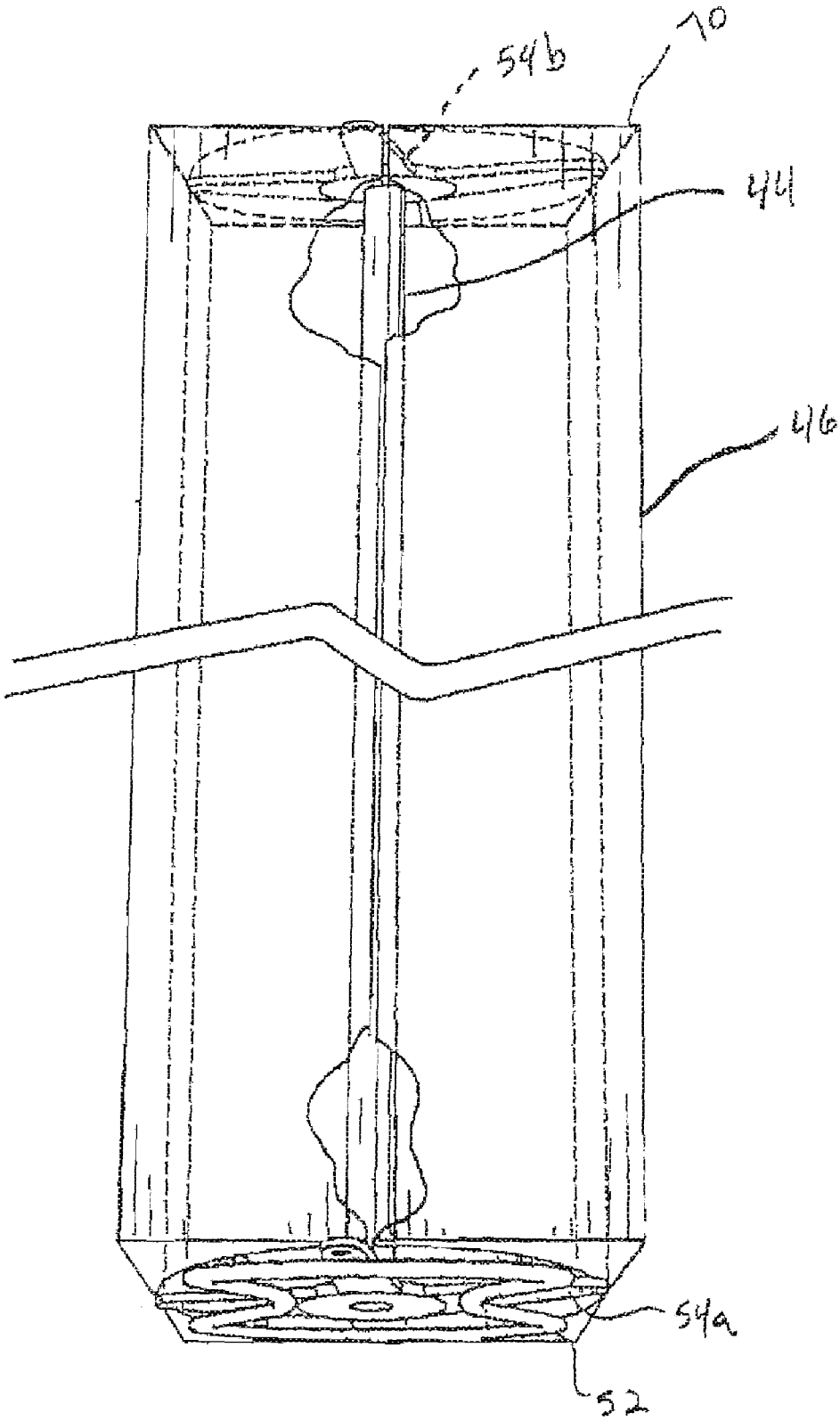
FIG. 11 is a partial perspective view having portions cut away of the column member illustrated in FIG. 5 connected to a display engagement member adjacent top and bottom portions thereof.

Referring now back to FIG. 11, another aspect of the display system 40 is now described in greater detail. The display system 40 may illustratively comprise a pair of opposing display engagement members 54*a*, 54*b*. More specifically, the first display engagement member 54*a* may be positioned adjacent a bottom portion of each column connection member 44. The second display engagement member 54*b* may engage a top portion of each column connection member 44 and may also engage a top portion of the frame 42. Accordingly, the pair of opposing display engagement members 54*a*, 54*b* may advantageously enhance stability of the column members 46 when connected to the frame 42.

The display members 50 may each comprise a base 72, a first side 74 and a second side 76 positioned adjacent the first side. The first and second sides 74, 76, of the display member 50 are preferably connected to the base 72 and extend upwardly therefrom. Further, each display member 50 may include a top 79 that overlies and connects to the first and second sides 74, 76 of the display member 50. The first and second sides of each display member 76, 78 are preferably substantially flat and positioned normal to one another, i.e., ends of the first and second sides of the display member meet to form a 90 degree corner.

In the attached drawings, the column members 46 are carried by the frame 42 in a vertical position. Those skilled in the art, however, will appreciate that the column members 46 may also be carried in a horizontal position by the frame 42. The column members 46 may have a length extending substantially the distance from a bottom portion of the frame 42 to a top portion of the frame. Of course, in those instances where the column members 46 are positioned in a horizontal configuration, the length of the column members may extend substantially the length between side portions of the frame 42.

In a typical use of the display system 40 as a roadside billboard, the first and second sides 74, 76 of the display members 50 preferably have a width of about 1.5 to 6 inches. Accordingly, when the display members 50 are positioned adjacent one another, a column member 46 may have a width between about 3 to 12 inches. Of course, since the display system 40 of the present invention may be used for displaying any type of sign 41, the size of the display members 50 may be any suitable size for displaying the desired sign.

As perhaps best illustrated in FIG. 6, the base 72 of the display members 50 may have a plurality of pin receiving passageways 71 formed therein. Accordingly, the pin members 56 may engage the pin receiving passageways 71 to connect the display members 50 to the display engagement member 54 and the display guide 52.

Figure 13:
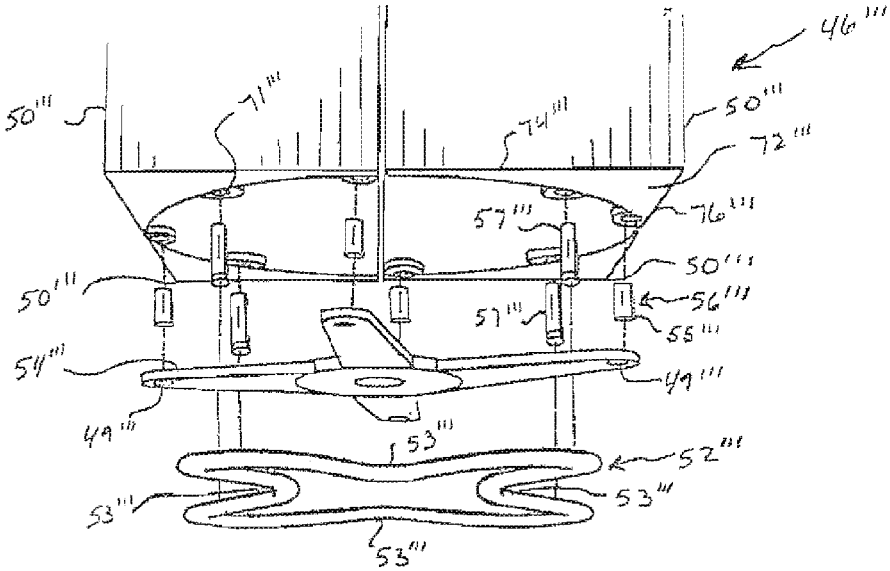
FIG. 13 is an exploded partial perspective view of a column member connected to another embodiment of the display guide according to the present invention.
Figure 14:
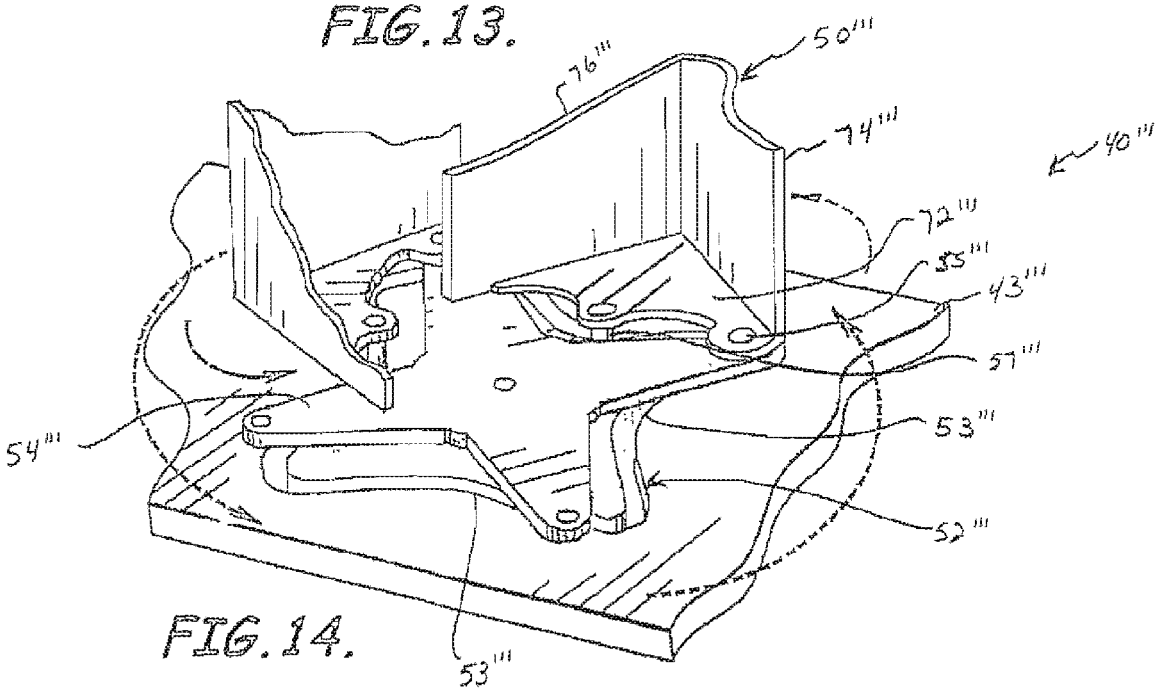
FIG. 14 is a partial perspective view of a column member connected to still another embodiment of a display guide according to the present invention.

Referring now additionally to FIGS. 13 and 15A-15E, still another embodiment of the display guide 52''' is now described. As illustrated in FIG. 13, the display guide 52''' may have a star shape defined by concave front, rear and side portions 53'''. As perhaps best illustrated in FIGS. 15A-15E, the display members 50''' may pivot inwardly when adjacent the concave front, rear and side portions 53''' as the column member 46''' rotates.

Similar to the embodiment of the display guide 52''' having an hourglass shape, the embodiment of the display guide having a star shape may also be provide by a display guide track, or a display guide slot formed in the display guide base 43'''. With respect to the display guide track 52''', the plurality of pin members 56''' may include track engagement pin members 57''' that engage each of the display members 50''' to the display guide. The plurality of pin members 56''' may also include a plurality of display engagement pin members 55''' for engaging the display members 50''' to the display engagement member 54'''.

FIGS. 15A-15E illustrate movement of the column member 46''' between a first position, as illustrated in FIG. 15A, and a second position, as illustrated in FIG. 15E. The movement of this embodiment of the column member 46''' is similar to the movement of the first embodiment of the column member 46 illustrated in FIGS. 7A-7E. More particularly, FIGS. 15B-15C illustrate the column member 46''' being moved between the first position and the second position. As illustrated in FIGS. 15B-15D, the display members 50''' pivot inwardly when adjacent the concave side portions 53''' of the display guide 52'''. The other elements of this embodiment of the invention are similar to those of the first embodiment, are labeled with triple prime notation, and require no further discussion herein.

Referring now additionally to FIGS. 18-22, another embodiment of the display system 40'''' is now described in greater detail. This embodiment of the display system 40'''' includes a magnetic drive assembly 80'''' that is carried by the frame (not shown). The magnetic drive assembly 80'''' may engage the column connection members 44'''' to selectively rotate the column members 46''''.

The magnetic drive assembly 80'''' may illustratively include a power source 82'''', and a plurality of energizing members 84'''' connected thereto. The energizing members 84'''' illustratively include a plurality of electromagnets 85''''. Although the energizing members 84'''' of the magnetic drive assembly 80'''' are illustrated with a plurality of electromagnets 85'''', those skilled in the art will appreciate that the energizing members may also be provided with one electromagnet.

The energizing members 84'''' may be provided by energizing disks having a bottom portion 86'''', sidewalls 87'''' extending upwardly from the bottom portion, and a top portion 88** overlying the bottom portion and connected to the sidewalls. The electromagnets 85**** may be positioned adjacent the bottom portion 86**** of the energizing disks and, more specifically, adjacent the outer periphery thereof. Those skilled in the art will appreciate that, as discussed above, the electromagnet 85**** may be provided by a single electromagnets positioned adjacent the outer periphery of the bottom portion 86****** of the energizing disk.

The magnetic drive assembly 80** may also include a plurality of column movement members 90**** connected to the column connection members 44****. The column movement members 90**** may be positioned spaced-part from, and overlying, the energizing members 84******.

The column movement member 90** may have a bottom portion 92****, sidewalls 94****, and a top portion 96**** overlying the bottom portion and connected to the sidewalls. The column movement member 90**** may also comprise a drive member 98**** having an arcuate shape and positioned adjacent an outer periphery of the bottom portion 92****. Of course, those skilled in the art will understand that the column movement member 90**** may include a plurality of drive members 98**** positioned adjacent the outer periphery of the bottom portion 92**** thereof. More particularly, the plurality of drive members 98**** may be provided by four drive members, each having an arcuate shape and spanning slightly less than 90 degrees adjacent the outer periphery of the bottom portion 92**** of the column movement member 90****. The four drive members 98**** are preferably spaced-apart to allow 90 degree rotation of the column members 46******.

Figure 18:
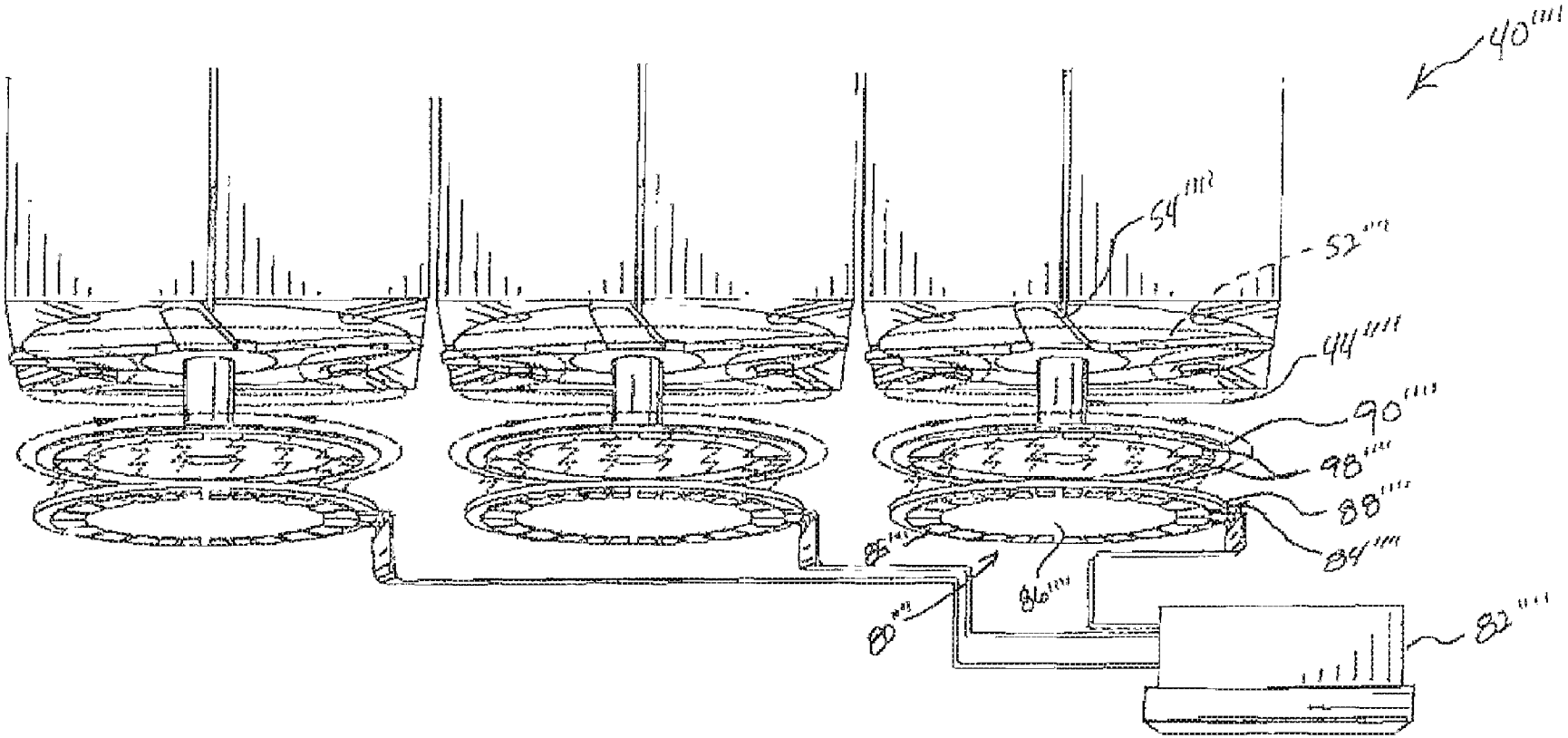
FIG. 18 is a partial perspective view of a plurality of column members engaging a magnetic drive assembly according to the present invention.
Figure 19:
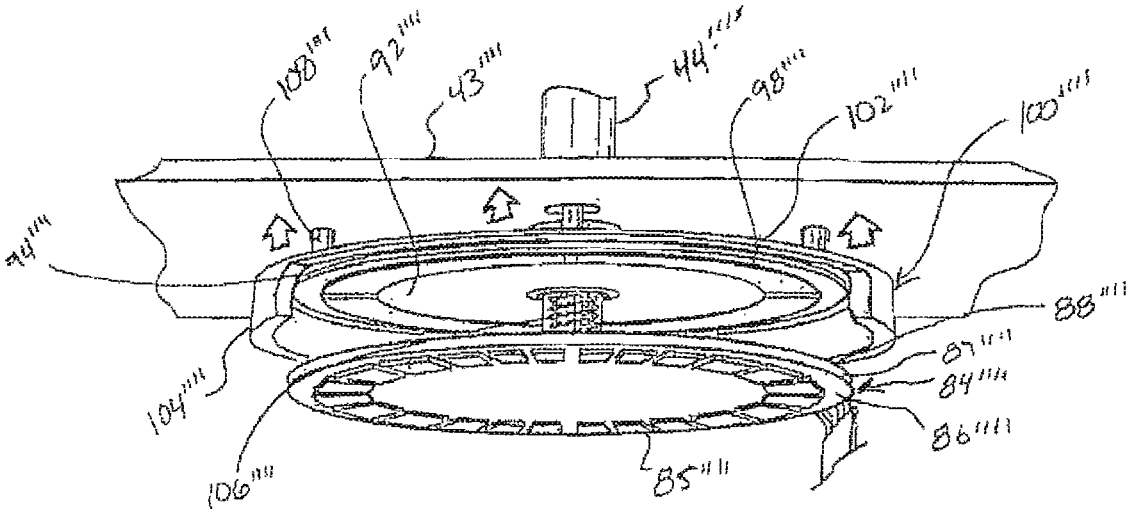
FIG. 19 is a partial perspective view of the magnetic drive assembly illustrated in FIG. 18 being shown in a disengaged lock position.
Figure 20:
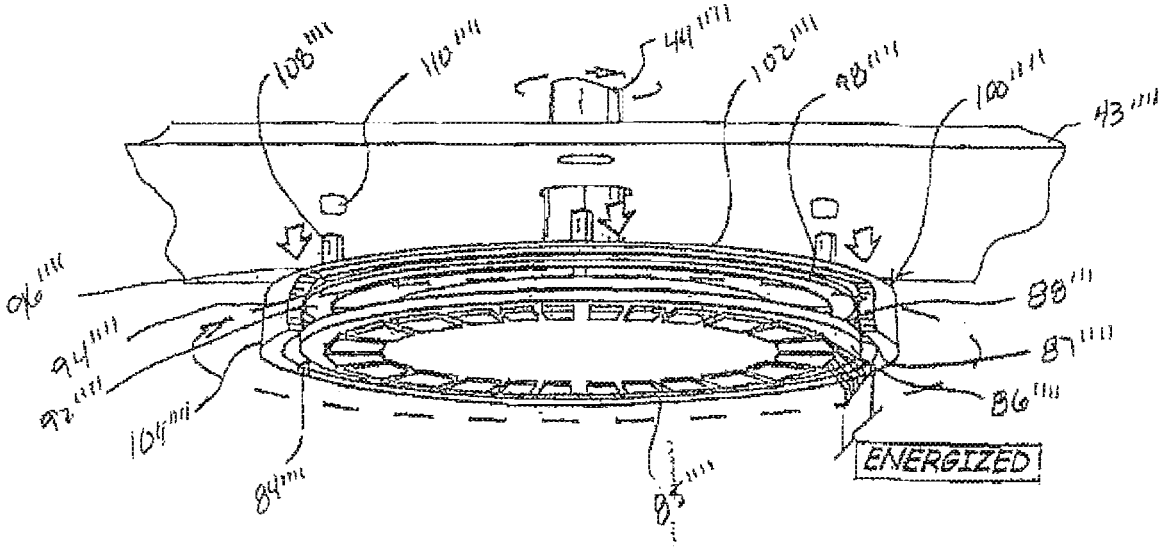
FIG. 20 is a partial perspective view of the magnetic drive assembly illustrated in FIG. 19 being shown in an engaged and unlocked position.

The electromagnet 85** of each of the energizing members 84**** may be selectively energized to form a magnetic field between the energizing members and the column movement members 90****. The magnetic field preferably causes rotation of the column members 46****. As illustrated in FIGS. 18-20, and as described in detail above, the energizing members 84**** may comprise a plurality of electromagnets 85****. The plurality of electromagnets 85**** are preferably spaced-apart and in communication with one another. Each of the plurality of electromagnets 85**** may be individually energized to form a magnetic field between a selective one of the electromagnets and the drive member 98******.

Selectively and individually energizing the electromagnets 85** advantageously provides a moving magnetic field between the electromagnets and the drive member 98**** of the column movement member 90****. The moving magnetic field causes rotation of the column connection members 44**** to which the magnetic drive assembly 80**** is connected, thereby causing rotation of the column members 46******.

As perhaps best illustrated in FIGS. 19 and 20, the magnetic drive assembly 80** may also include a return cover 100**** connected to each column movement member 90****. More particularly, the return cover 100**** overlies the column movement member 90****, and includes a top 102**** and sidewalls 104**** connected to, and extending downwardly from, the top. The sidewalls 104**** of the return cover 100**** overlie the energizing member 84****. More specifically, the sidewalls 104**** of the return cover 100**** overlie the sidewalls 87**** of the energizing members 84****. The return cover 100**** may advantageously prevent trash or other debris from collecting between the energizing member 84**** and the column movement member 90******.

The column movement members 90** are preferably moveable between an engaged position and a disengaged position. FIG. 19 illustrates the column movement member 90**** in the engaged position. FIG. 20 illustrates the column movement member 90****** in the disengaged position.

A spring member 106** may be positioned between the energizing member 84**** and the column movement member 90****. When the electromagnets 85**** of the energizing member 84**** are energized, the column movement member 90****, and more specifically, the drive member 98****** connected to the column movement member, are drawn downwardly towards the energizing member.

Accordingly, as the column movement member 90** is drawn downwardly towards the energizing member 84****, the spring member 106**** is compressed. When power to the electromagnets 85**** is cut off, the column movement member 90**** may move back to the engaged position. More specifically, the spring member 106**** may move from a compressed position to a relaxed position to assist in moving the column movement member 90**** to the engaged position. Those skilled in the art will appreciate that the column movement member 90****** may also be moved between the engaged and the disengaged positions using an actuator, for example, or any other mechanism suitable for moving the column movement member between the engaged and disengaged positions.

The return cover 100** may include a plurality of lock members 108**** connected to the top portion 102**** thereof. The display guide base 43**** may have a plurality of lock member passageways 110**** formed therein. The lock members 108**** may selectively engage the lock member passageways 110**** to prevent rotation of the column members 46**** when the electromagnets 85**** are not energized, i.e., when the column movement member 90****** is in the engaged position.

Four lock member passageways 110** are preferably formed in the display base 43****. More specifically, the lock member passageways 110**** are preferably positioned along an imaginary circular path formed in the display base 43****. To accommodate the preferred 90 degree rotation of the column members 46****, the lock member passageways 110****** are preferably spaced 90 degrees apart along the imaginary circular path.

Similarly, the lock members 108** on the top portion 102**** of the return cover 100**** are preferably spaced 90 degrees apart along an imaginary circular path on the top of the return cover. Accordingly, when the column members 46**** are positioned in any one of the first, second, third and fourth positions, the column movement member 90**** is preferably in the engaged position, as illustrated in FIG. 19. When the column movement member 90**** is in the engaged position, the lock members 108**** engage the lock member passageways 110**** to prevent rotation of the column movement member 90**** which, in turn, prevents rotation of the column members 46****. Similarly, when the electromagnets 85**** are energized, the drive member 98**** of the column movement member 90**** is drawn downwardly, moving the column movement member to the disengaged position. When the column movement member 90**** is in the disengaged position, the lock members 108**** are disengaged from the lock member passageways 110**** allowing rotation of the column movement members which, in turn, allows for rotation of the column members 46****. Although four lock members 108**** and four lock member passageways 110**** are illustrated in FIGS. 19 and 20**, those skilled in the art will appreciate that the objects of the present invention may be accomplished using any number of lock members and lock member passageways.

Figure 21:
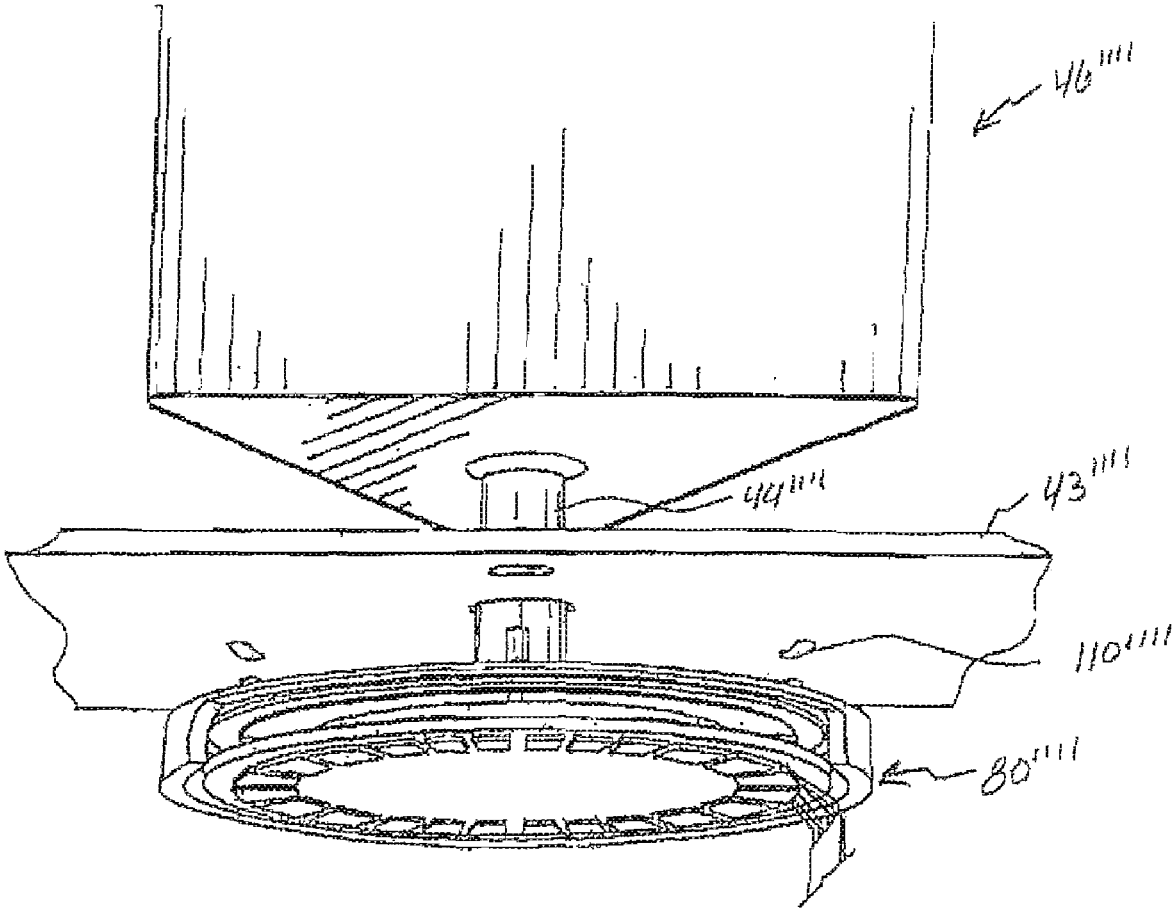
FIG. 21 is a partial perspective view of a magnetic drive assembly of the present invention connected to a column member.

As illustrated in FIG. 21, the magnetic drive assembly 80** of the present invention may advantageously be used to rotate any type of column member 46**** of any display system 40****. More particularly, and as illustrated in FIG. 21, the magnetic drive assembly 80**** may be used to rotate a three-sided column member 46''''. Of course, it is understood that when using the magnetic drive assembly 80'''' of the present invention to rotate a three-sided column member 46'''', it is appropriate to use three lock members 108'''' and three lock member passageways 110''''. In such a configuration, the lock members 108'''' and the respective lock member passageways 110'''' are spaced 120 degrees apart to allow for rotation of the three-sided column members 46**'''' between three positions.

Those skilled in the art will also appreciate that the magnetic drive assembly 80'''' of the present invention may be used to rotate any object. More specifically, the magnetic drive assembly 80'''' may be used to rotate platforms suitable for displaying both large and small objects. For example, a rotating jewelry display for rotating an article of jewelry may be rotated using a magnetic drive assembly 80'''' of the present invention. Also, for example, a rotating automobile display for rotating an automobile at an automobile show may be rotated using a magnetic drive assembly 80'''' of the present invention.

Figure 22:
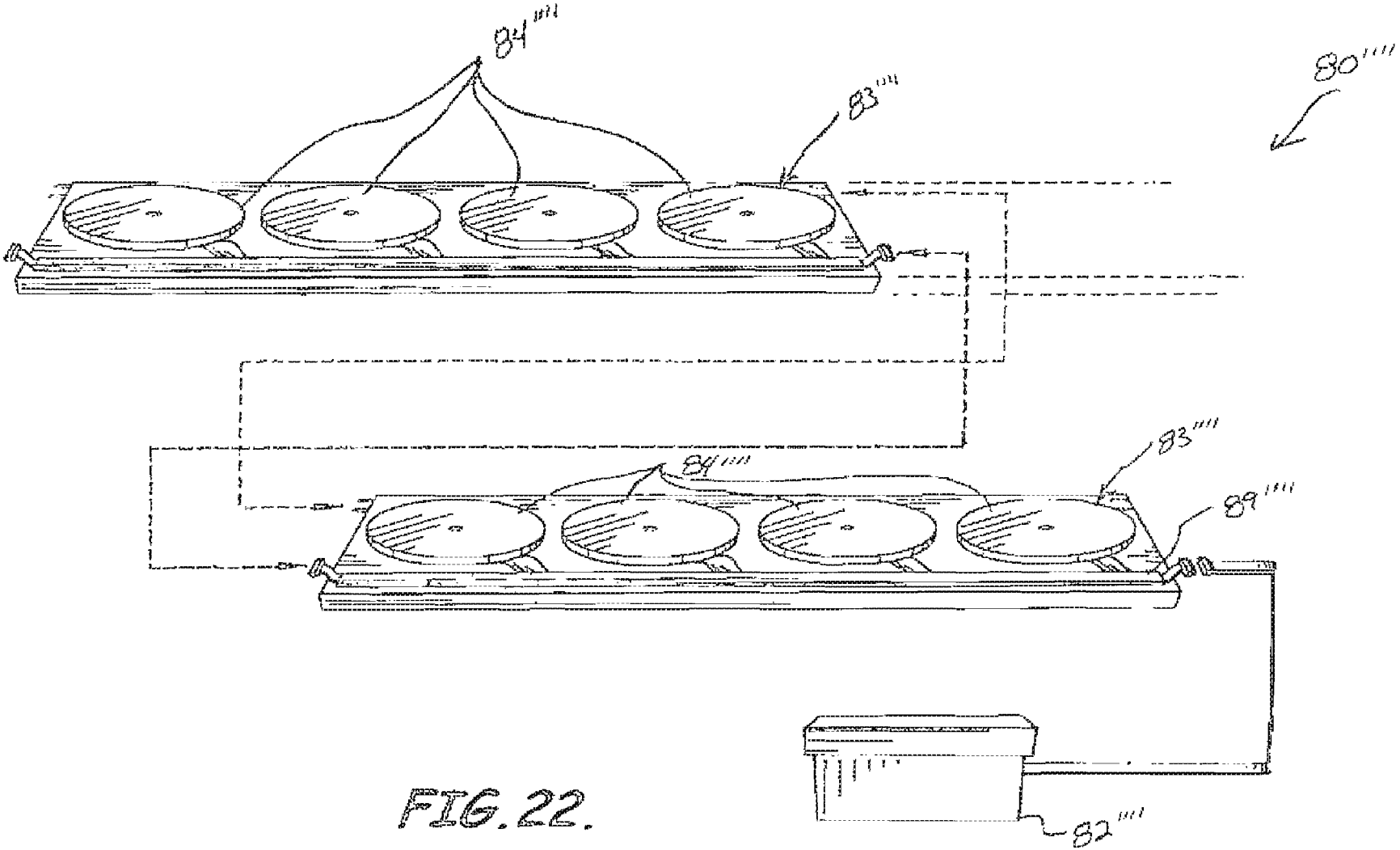
FIG. 22 is a perspective view of a plurality of energizing members of the magnetic drive assembly of the present invention connected in series.

Referring now additionally to FIG. 22, the plurality of energizing members 84'''' may be carried by an energizing base 83''''. The energizing member base 83'''' may have a combined power and data line 89'''' positioned to extend the length thereof. The energizing members 84'''' may be connected in series to the power and data line 89''''.

The power and data line 89'''', of course, is connected to the power source 82''''. Accordingly, the energizing members 84'''' may be connected to the power source in series. The data portion of the combined power and data line 89'''' may transmit programming data to the display system 40'''' to define desired rotation of the column members 46''''. The other elements of this embodiment of the invention are similar to those of the first embodiment of the invention, are labeled with quadruple prima notation, and require no further discussion herein.

Figure 23:
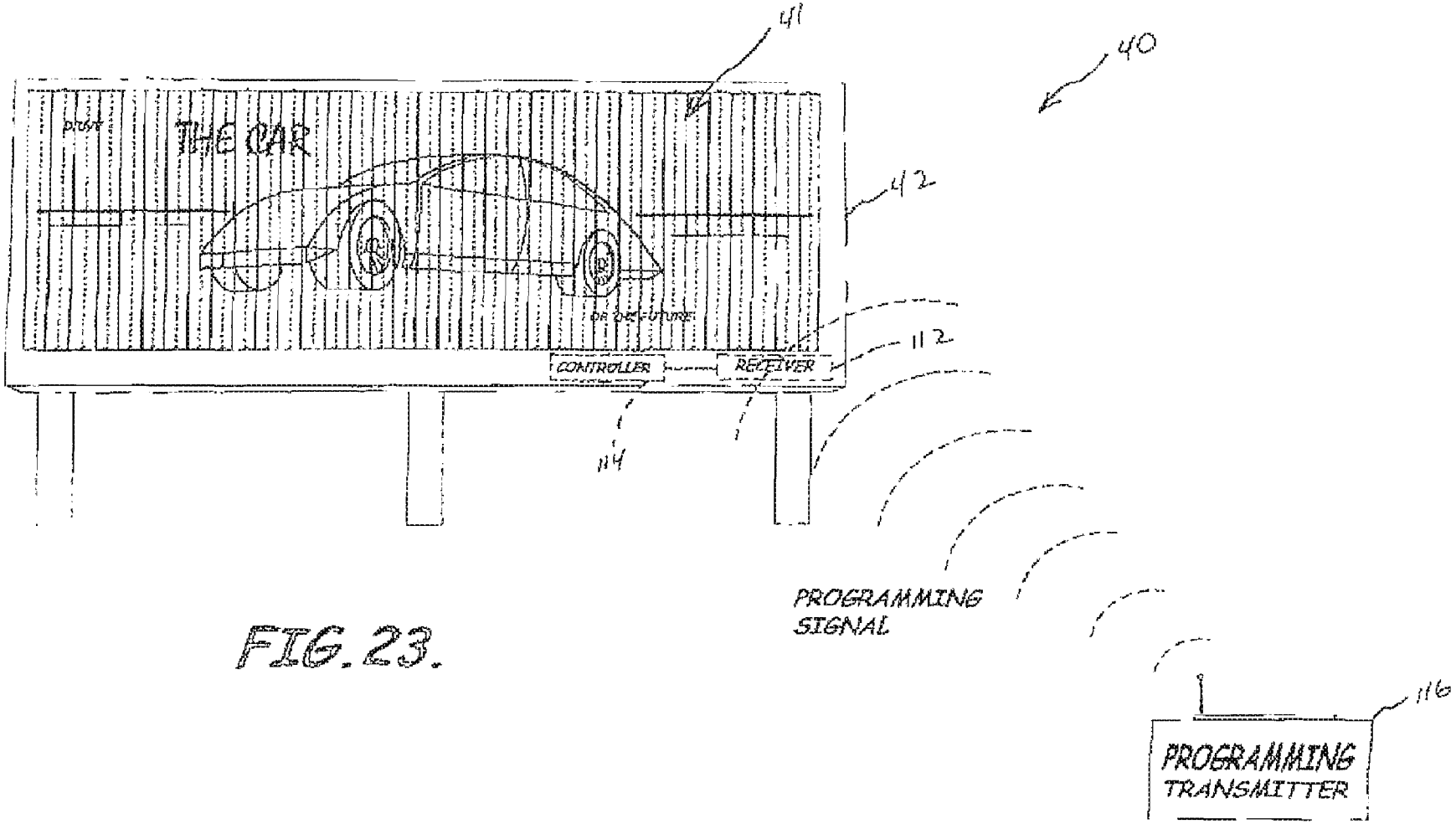
FIG. 23 is an environmental view of the display system receiving a signal from a remote transmitter according to the present invention.

As illustrated in FIG. 23, a controller 112 may be carried by the frame 42. A receiver 114 may also be carried by the frame 42 and in communication with the controller 112. The receiver 114 may receive a predetermined signal to rotate each column member 46 upon receipt of the predetermined signal.

The display system 40 may also include a remote transmitter 116 for transmitting the predetermined signal to the receiver 114. More specifically, the remote transmitter 116 may advantageously be used to control the rotation of the column members 46 from a remote location. This advantageously allows a user to selectively display predetermined sides of the column members from a remote location. The predetermined signal may, for example, be a radio frequency signal, an infrared signal, a hard-wired cable signal, or any other type of signal suitable for controlling rotation of the column members 46 as understood by those skilled in the art.

Figure 24:
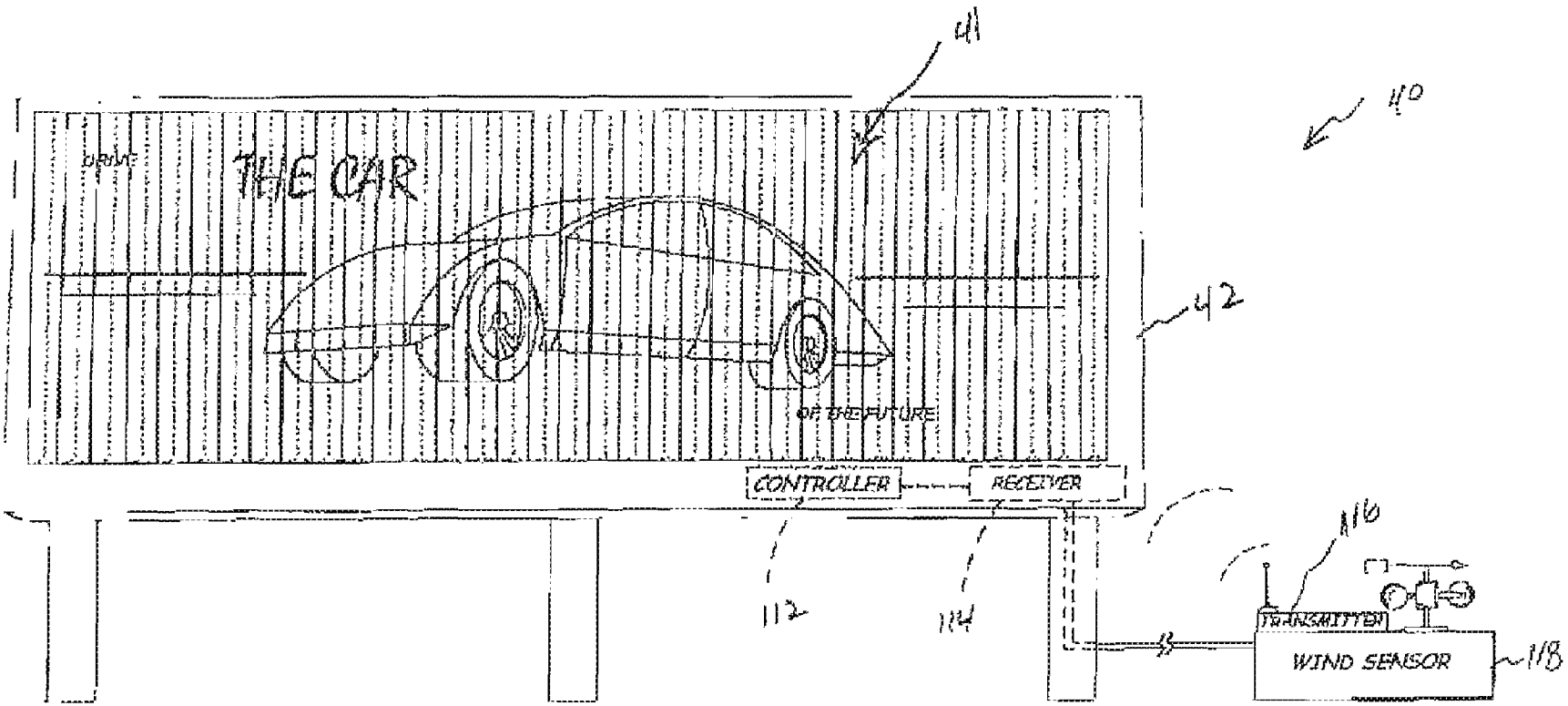
FIG. 24 is an environmental view of a display system in communication with a wind sensor according to the present invention.

As illustrated in FIG. 24, the display system 40 may also comprise a wind sensor 118 positioned adjacent the frame 42. The wind sensor 118 preferably senses wind speed and wind direction. The wind sensor 118 illustrated in FIG. 24 is illustrated adjacent to the frame 42 of the display system 40, but those skilled in the art will appreciate that the wind sensor may also be carried by the frame.

The wind sensor 118 is preferably in communication with the controller 112. Further, the wind sensor 118 may include a remote transmitter 116 for transmitting a predetermined signal to the receiver 114 based on a predetermined wind speed and wind direction sensed by the wind sensor. Accordingly, each column member 46 may be rotated to a position between any one of the first, second, third and fourth positions responsive to the predetermined signal received from the remote transmitter 116 on the wind sensor 118.

More particularly, the wind sensor 118 may rotate the column members 46 to a position similar to those illustrated in FIGS. 7B-7D and 15B-15D to advantageously enhance stability of the display system 40 when encountered with direct winds. The position of the column members 46 illustrated in FIGS. 7B-7D and 15B-15D provides a gap therebetween. Further, a corner of one of the display members 50 may be positioned outwardly, i.e., in a direction facing a direct wind load. Accordingly, when encountered with a predetermined direct wind load, rotation of the column members 46 may be stopped so that a corner of the display members 50 is facing the wind load, thereby displacing the force of the wind load. More specifically, the surface area of the column members 46 may be reduced to allow wind to pass therebetween.

When the wind sensor 118 is used in connection with an embodiment of the invention using the magnetic drive assembly 80'''', the column members 46 may be locked into a position between any one of the first, second, third and fourth positions, in response to a predetermined signal received from the wind sensor. More particularly, a plurality of lock member passageways 110'''' may be formed in the display base 43'''' suitable for engaging the lock members 108'''' on the return cover 100'''' so that the column members 46 may be stopped in a position between any of the first, second, third and fourth positions.

Figure 27:
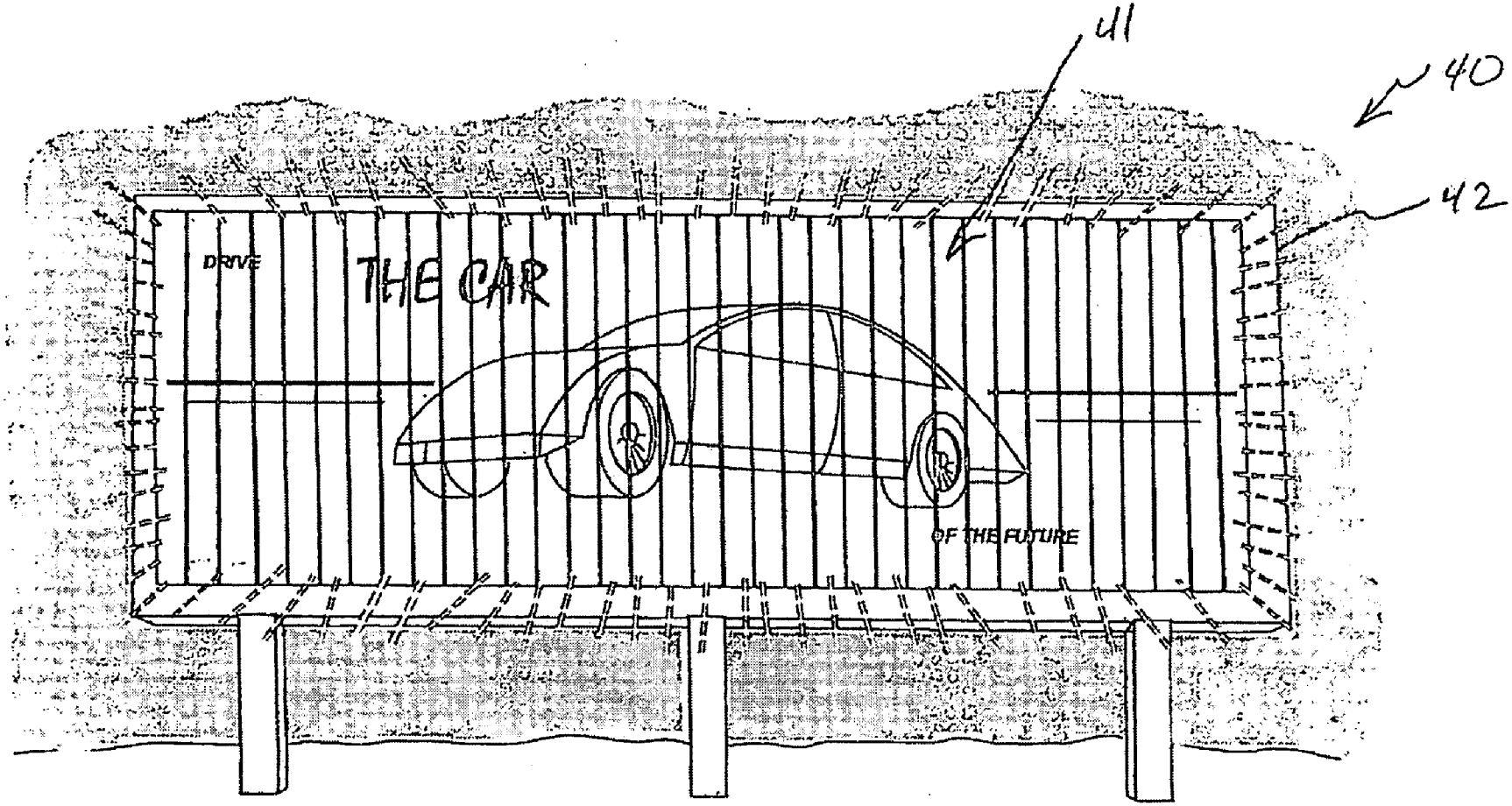
FIG. 27 is an environmental view of an illuminated display system.

Referring now additionally to FIGS. 25-27, another aspect of the display system 40 is now described in greater detail. More specifically, the display system 40 may include an illumination assembly 120. The illumination assembly 120 may include an elongate light source 122 positioned adjacent a medial portion of each column member 46 and connected to a power source. More specifically, the light source 122 may be positioned adjacent the column connection member 44. The light source 122 in FIGS. 25 and 26 is illustrated as elongate lights, such as fluorescent lights, for example. Those skilled in the art, however, will appreciate that any type of illumination source may be provided to illuminate the display system 40.

FIG. 25 shows the column members 46 being moved between any one of the first, second, third and fourth positions, i.e., the display members 50 are pivoting in a predetermined direction to allow for rotation of the column members 46. When the column members are positioned between any one of the first, second, third and fourth positions, the light source 122 is in an off position, so as not to be visible during rotation of the column members 46. When the column members are positioned in any one of the first, second, third and fourth positions, as illustrated in FIG. 26, the light source 122 is illuminated to back light the indicia 99 on the display members 50, as illustrated in FIG. 27.

A method aspect of the present invention is for display indicia 99. The method may include positioning the indicia 99 on the display members 50. More specifically, the indicia 99 may be positioned on the first and second sides 74, 76 of the display members 50. The indicia 99 is preferably advertising indicia, but those skilled in the art will appreciate that the indicia may be any other type of indicia desired to be displayed.

The method may also include rotating the plurality of column members 46 so that the indicia 99 on each of the four-sides of the column members may be selectively displayed. Rotating the plurality of column members 46 may comprise pivoting the display members 50 in a predetermined direction to change the shape of the column members. As discussed in greater detail above, changing the shape of the column members 46 during rotation thereof allows for a plurality of column members positioned adjacent one another to be simultaneously rotated.

Another method aspect of the present invention is for rotating a column member 46. The method may include selectively energizing an electromagnet 85** of the energizing member 84** to form a magnet field between electromagnet of the energizing member and the drive member 98** of the column movement member 90** to selectively rotate the column member 46****.

Referring now additionally to FIGS. 28-46, another embodiment of the display system 200 according to the present invention is now described in greater detail. This embodiment of the display system shall begin numbering with 200.

Figure 28:
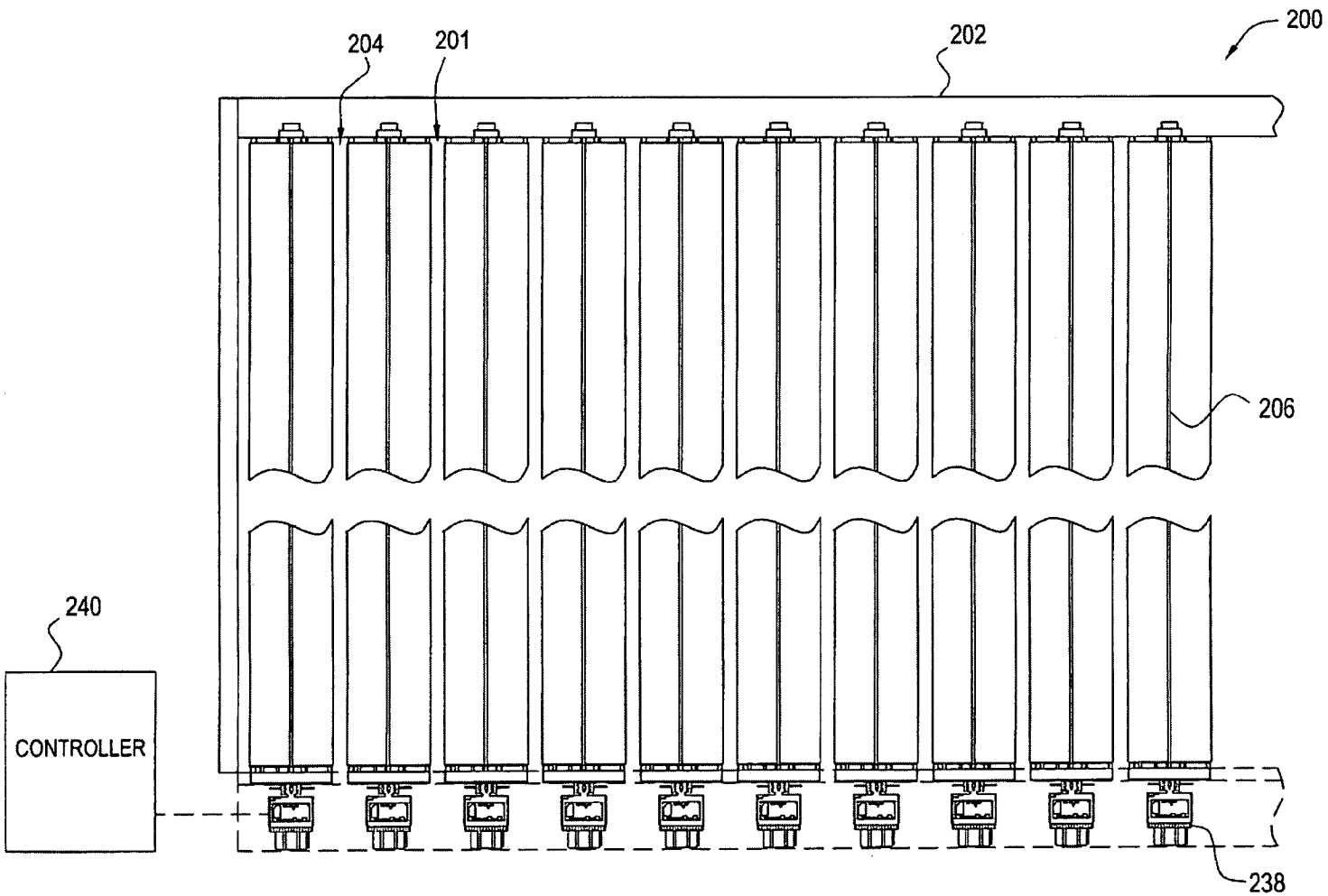
FIG. 28 is a partial perspective view of the display system according to the present invention.
Figure 29A:
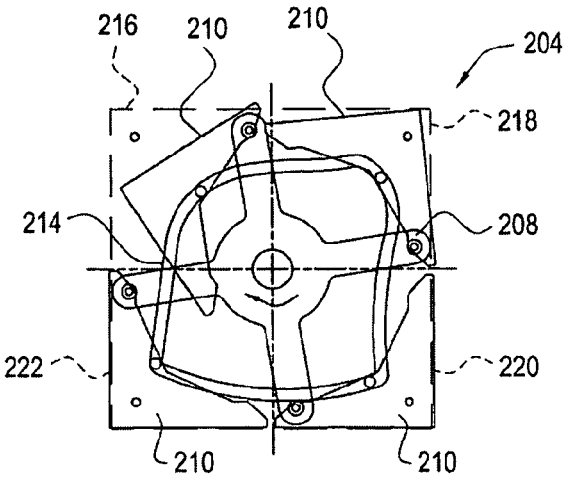
FIGS. 29A-29D are top plan views of a rotatable column of the display system illustrated in FIG. 28 in the various stages of rotation.
Figure 29B:
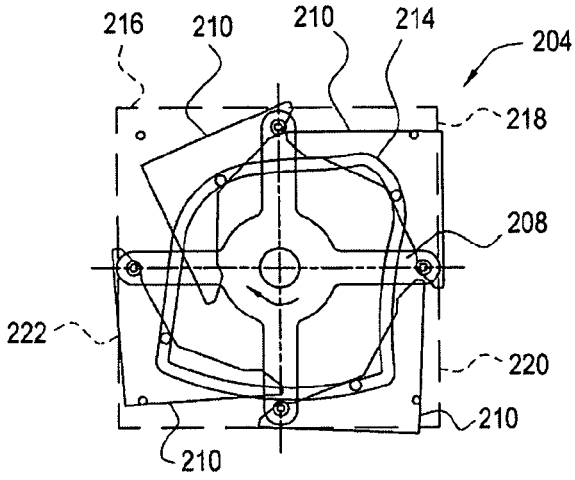
Figure 29C:
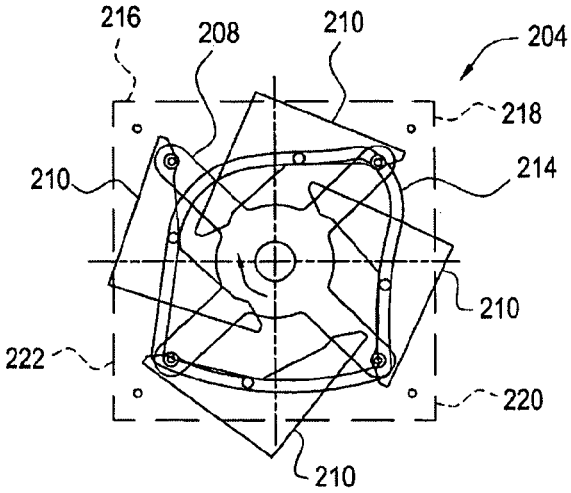
Figure 29D:
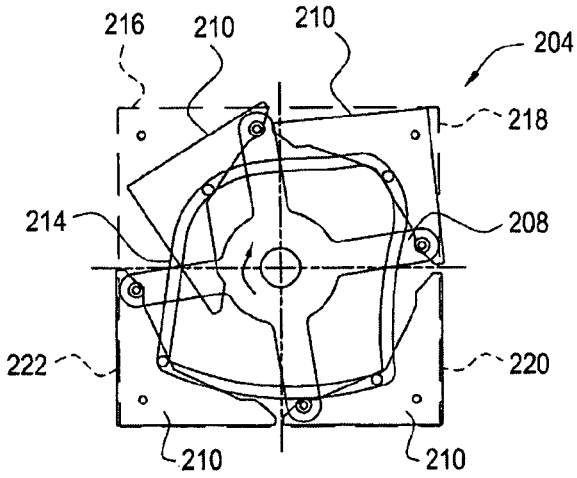
Figure 30:
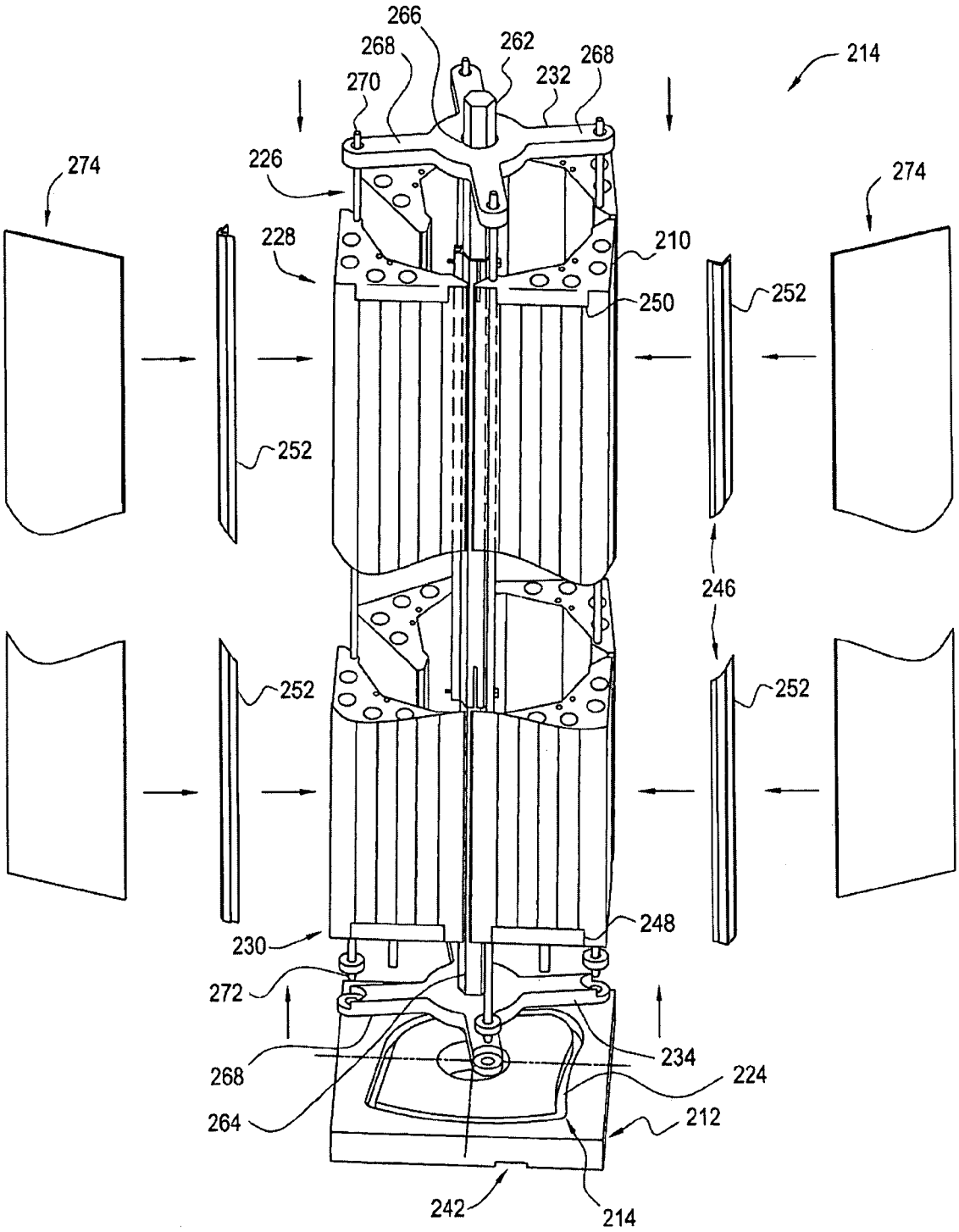
FIG. 30 is an exploded perspective view of a rotatable column of the display system illustrated in FIG. 28.

As perhaps best illustrated in FIG. 28, this embodiment of the display system 200 includes a frame 202 and a plurality of rotatable columns 204 carried by the frame. Each of the plurality of rotatable columns 204 includes a column connection member 206, a display engagement member 208 carried by the column connection member and a plurality of display members 210 carried by the display engagement member.

The plurality of rotatable columns 204 each preferably have a polygonal shape, such as a square column, for example. The polygonally shaped rotatable columns 204 are illustratively positioned adjacent one another. Accordingly, the display system 200 of the present invention advantageously allows for a plurality of polygonally shaped rotatable columns 204 positioned adjacent one another to be simultaneously rotated. The details of the movement of the rotatable columns 204 are described in greater detail below.

As perhaps best illustrated in FIGS. 29A-29D, the rotatable columns 204 change shape during rotation. As understood by those skilled in the art, a plurality of four-sided columns positioned adjacent one another generally cannot rotate without interfering with one another. At least one of the plurality of display members 210 of each of the rotatable columns 204 of the display system 200 according to the present invention, however, advantageously pivot to allow the plurality of rotatable columns to rotate when positioned adjacent one another. Those skilled in the art will appreciate that although the display system 200 is displayed as having a plurality of rotatable columns 204, a single rotatable column may be used to carry out the goals, features and objectives of the present invention. Accordingly, the components of the display system 200 already disclosed above, and that will be discussed in greater detail below, should be read as capable of working with a display system having any number of rotatable columns 204.

Each of the plurality of rotatable columns 204 preferably includes four display members 210 carried by the display engagement member 208. More particularly, the display members 210 are preferably pivotally connected to the display engagement member 208. Accordingly, during rotation of each of the rotatable columns 204, at least one of the display members 210 may pivot so that the plurality of rotatable columns may be rotated when positioned adjacent one another. The display member 210 that pivots preferably pivots inwardly towards the column connection member 206 during rotation of the rotatable columns 204.

The display system 200 may also include a respective plurality of display guide members 212. Each of the display guide members 212 may be carried by the frame 202 and may be adapted to engage each of the plurality of rotatable columns 204. As illustrated, for example, in FIG. 28, each rotatable column 204 may have a display guide member 212 associated therewith. As perhaps best illustrated in FIG. 30, the display guide member 212 is positioned adjacent the display engagement member 208 of the rotatable column 204.

Each of the display guide members 212 includes an arcuate shaped guide 214. Further, each display guide member 212 includes four imaginary quadrants 216, 218, 220, 222. A portion of the arcuate shaped guide 214 extends through each of the four imaginary quadrants 216, 218, 220, 222. Each portion of the arcuate shaped guide 214 that extends through each of the imaginary quadrants 216, 218, 220, 222 preferably has a different shape. Accordingly, and with reference to FIGS. 29A-29D, the arcuate shaped guide 214 is preferably a closed loop having various shapes throughout each of the four imaginary quadrants 216, 218, 220, 222.

Figure 43:
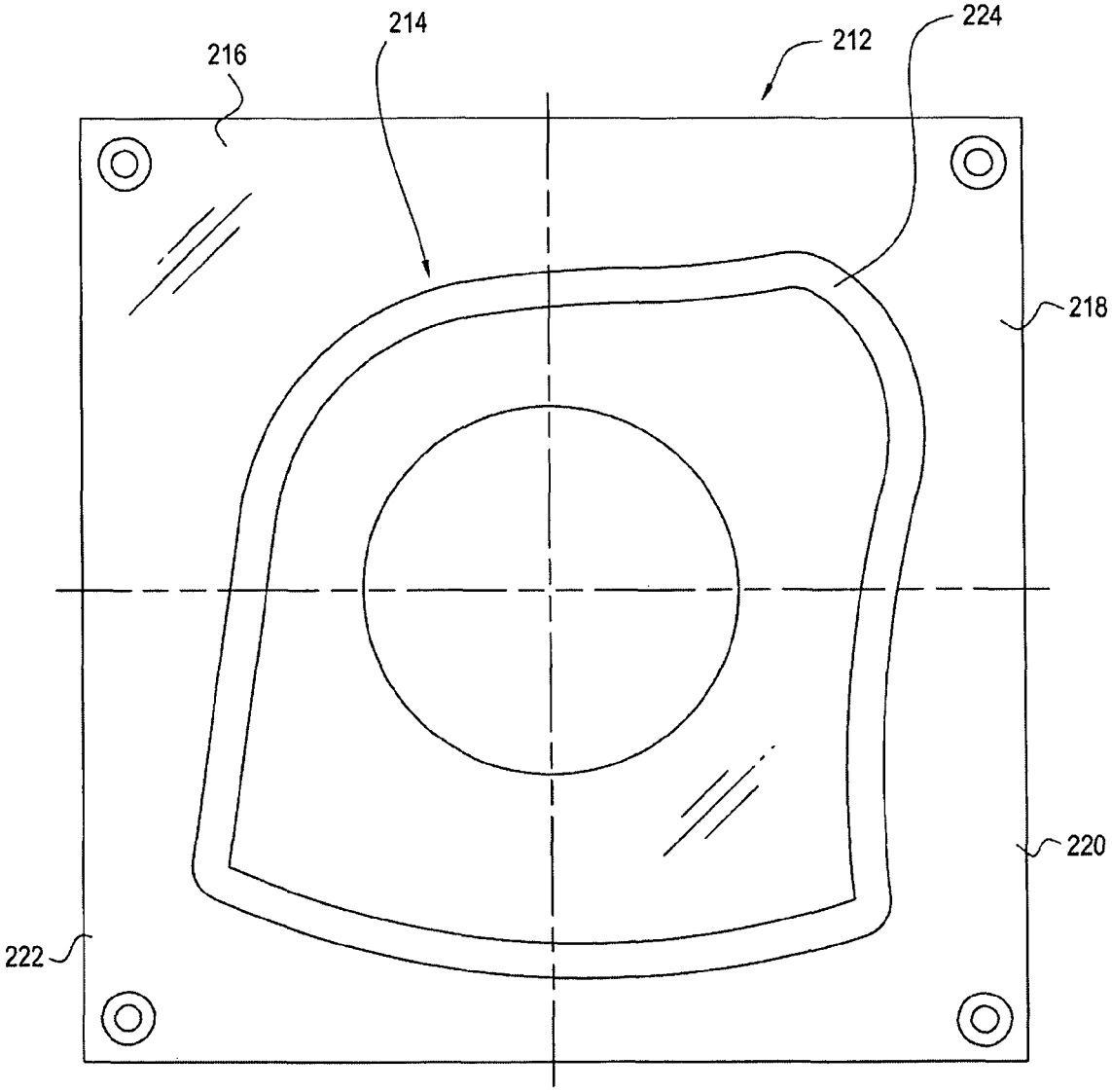
FIG. 43 is a top plan view of a display guide member according to the present invention.
Figure 44A:
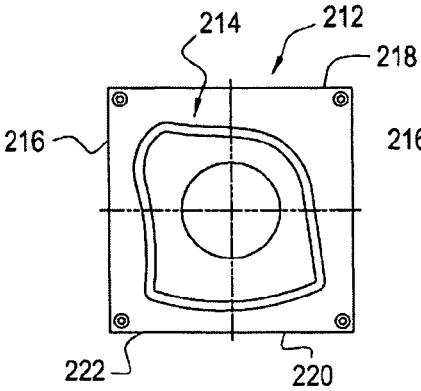
FIGS. 44A-44G are top plan views of alternate embodiments of the display guide member illustrated in FIG. 43.
Figure 44B:
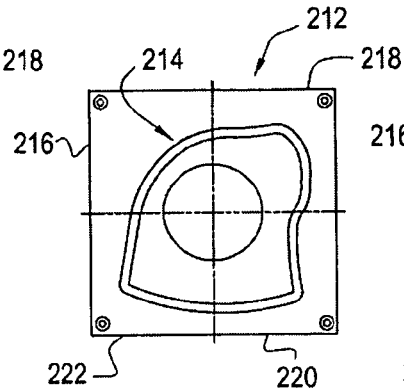
Figure 44C:
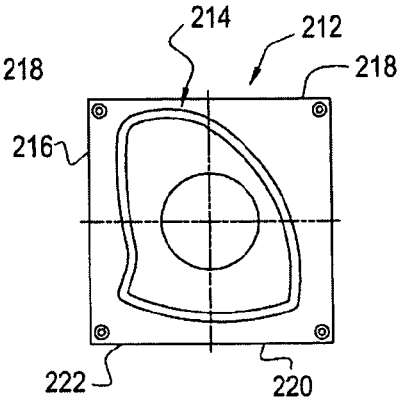
Figure 44D:
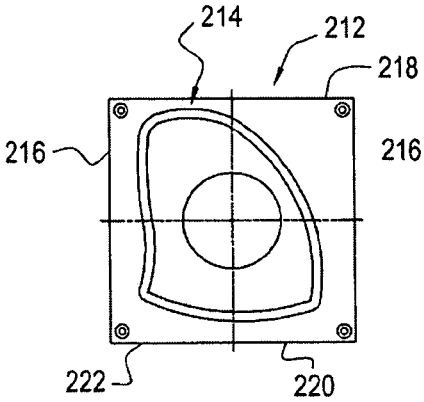
Figure 44E:
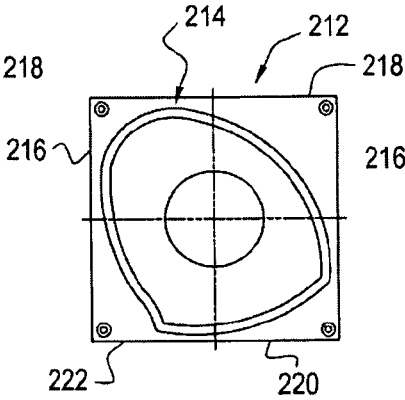
Figure 44F:
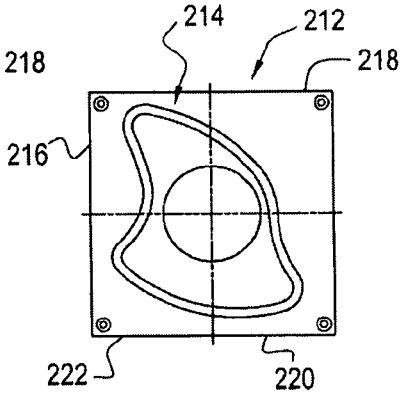
Figure 44G:
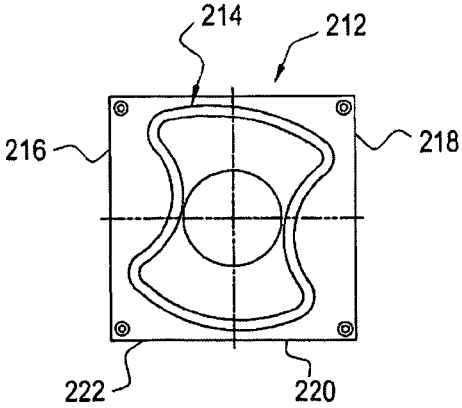

As perhaps best illustrated in FIG. 43, the arcuate shaped guide 214 may be defined by an arcuate shaped slot 224 formed in the plurality of display guide members 212. Each of the display guide members 212 is preferably made of a plastic composite material. This advantageously allows for the display guide member 212 to have high strength properties and lightweight properties. Plastic material also advantageously has good wearing properties, thereby decreasing maintenance concerns of the display guide members 212. Those skilled in the art will appreciate that the display guide members 212 may be made of any material.

The arcuate shaped slot 224 may be formed in the display guide member 212 so that each rotatable column 204 overlying the display guide member 212 may rotate in a predetermined pattern to allow for simultaneous rotation of the plurality of rotatable columns when positioned adjacent one another. The arcuate shaped slot 224 has an undefined shape, but is preferably a closed loop.

Those skilled in the art will appreciate that the display system 200 as a whole allows for the rotatable columns 204 to be independently rotated from one another. Accordingly, if so desired, one rotatable column 204 may be rotated at any given time, multiple rotatable columns may be rotated at any given time, or all of the rotatable columns may be rotated at any given time. This advantageously enhances the versatility of the display system 200. Those skilled in the art will also appreciate that the rotatable columns 204 may each be rotated in any direction. For example, each of the rotatable columns 204 may be rotated in either a clockwise or counterclockwise direction. Those skilled in the art will further appreciate that adjacent columns may be independently rotated in different directions. For example, a first column 204 may be rotated in a clockwise direction, while a second column, positioned adjacent the first column, or anywhere on the frame 202 for that matter, may be rotated in a counterclockwise direction.

As illustrated, for example, in FIGS. 44A-44G, the arcuate shaped guide 214 may have any number of shapes. In every instance, however, the arcuate shaped guide 214 formed in the display guide members 212 have an undefined shape and, more specifically, different shapes in each of the four quadrants 216, 218, 220, 222. Any of the shapes of the arcuate shaped guide 214 illustrated in FIGS. 44A-44G are suitable for use with the display system 200 of the present invention. Those skilled in the art, however, will appreciate that the arcuate shaped guide 214 illustrated in FIG. 43 is the preferably shape, while the other shapes illustrated in FIGS. 44A-44G are also acceptable to accomplish the goals and objectives of the claimed invention.

As noted above, each of the plurality of rotatable columns 204 includes a display engagement member 208. In the preferred embodiment of the invention, each rotatable column 204 includes a pair of display engagement members 208. The pair of display engagement members 208 may include a first display engagement member 232 carried by an upper portion 262 of the column connection member 206, and a second display engagement member 234 carried by a lower portion 264 of the column connection member.

The display engagement members 232, 234 may be defined by cross members having a center portion 266 and four outwardly extending arms 268. The center portion 266 of the display engagement members 232, 234 may include a passageway to engage the column connection member 206. More specifically, the passageway may have a diameter that is slightly larger than the diameter of the column connection member 206.

The embodiments of the display system illustrated in FIGS. 28-46 show a column connection member 206 having a hexagonal shape. Accordingly, in a case where the column connection member 206 has a hexagonal shape, the passageway in the center portion 266 of the display engagement members 232, 234 would similarly have a hexagonal shape. Those skilled in the art will appreciate that the column connection member 206 may have any shape, but it is preferred that the column connection member have a polygonal shape. Accordingly, if the column connection member 206 has a polygonal shape, the passageway in the center portion 266 of the display engagement members 232, 234 should likewise have a polygonal shape. Although any corresponding shaped column connection member 206 and passageway in the center portion 266 of the display engagement members 232, 234 may have any shape, the polygonal shape advantageously enhances strength and reliability of the rotatable columns 204.

Figure 31:
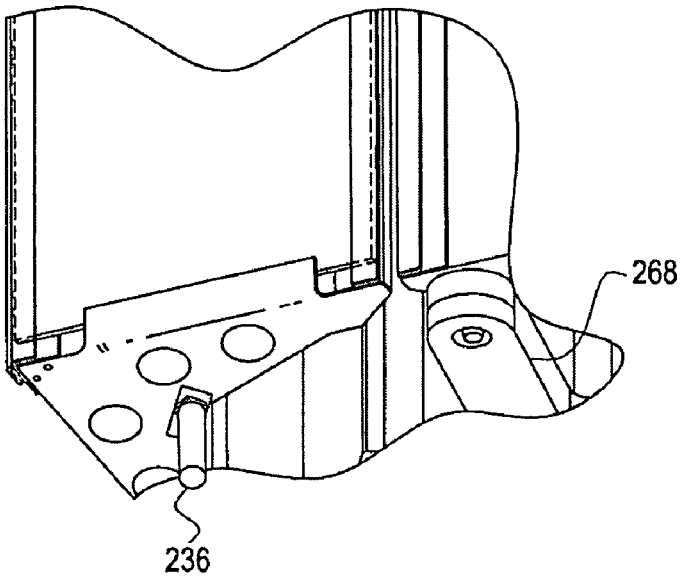
FIG. 31 is a partial perspective view of a display member of a rotatable column according to the present invention.
Figure 32:
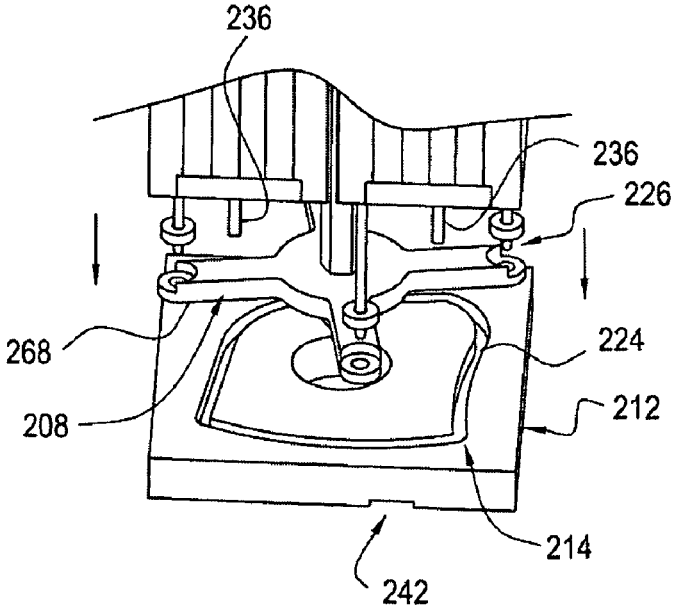
FIG. 32 is an exploded partial perspective view of a lower portion of a rotatable column according to the present invention.
Figure 33:
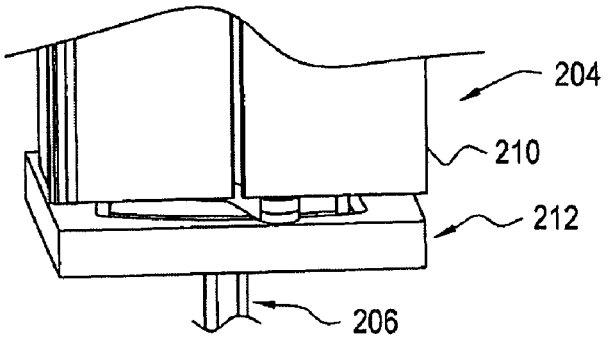
FIG. 33 is a partial perspective view of a lower portion of a rotatable column showing engagement between the rotatable column and a display guide member according to the present invention.
Figure 34:
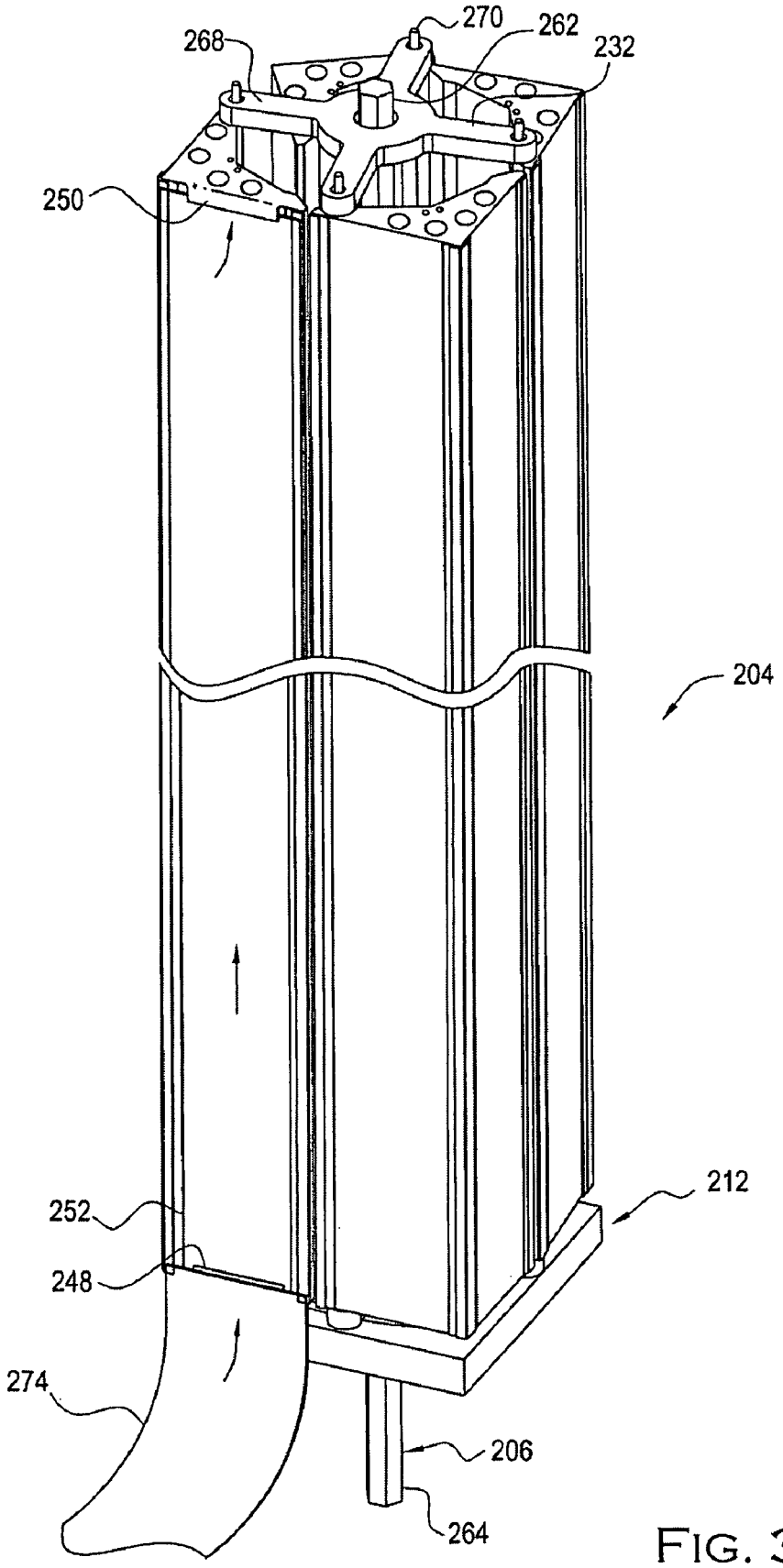
FIG. 34 is a partial perspective view having portions of a rotatable column showing indicia being positioned on a display member according to the present invention.
Figure 35:
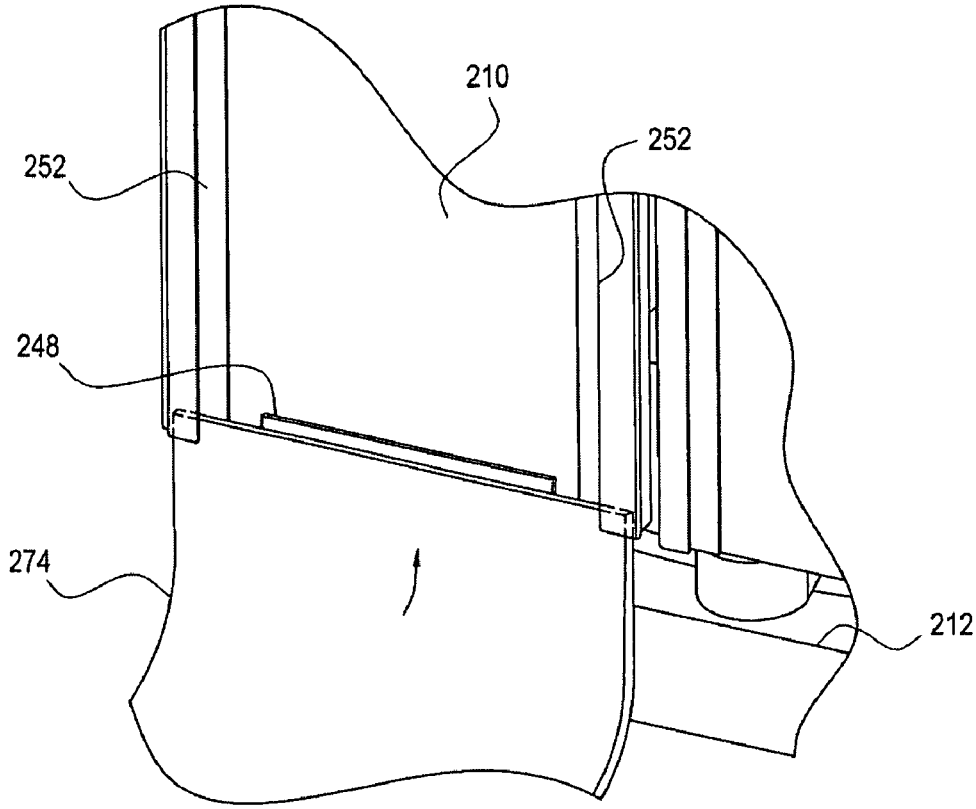
FIG. 35 is a partial perspective view of a display member having media fastening members connected thereto according to the present invention.
Figure 36:
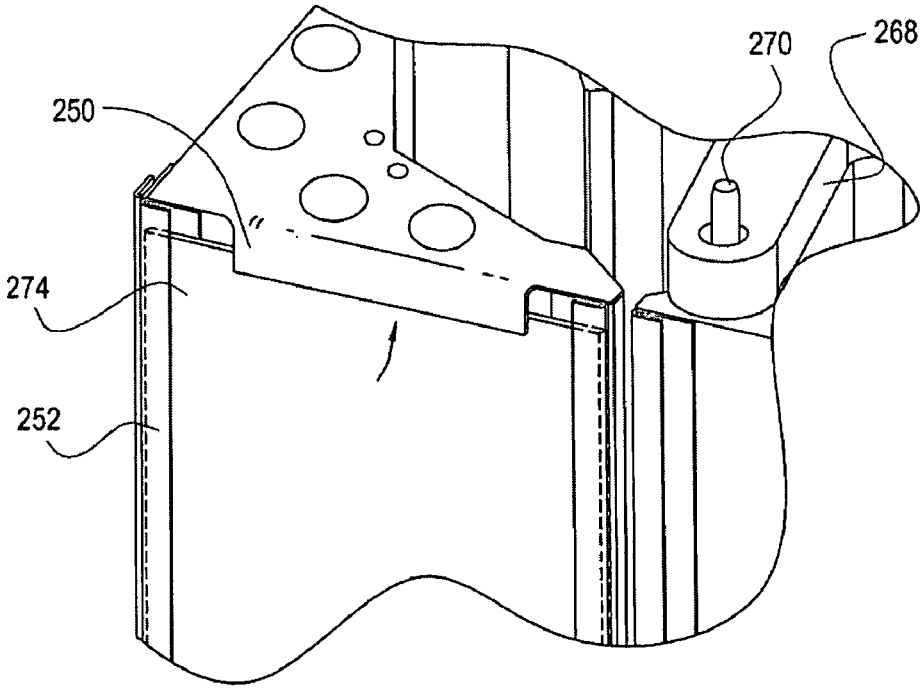
FIG. 36 is a partial perspective view of the display member illustrated in FIG. 35 having media fastening members connected thereto.
Figure 37:
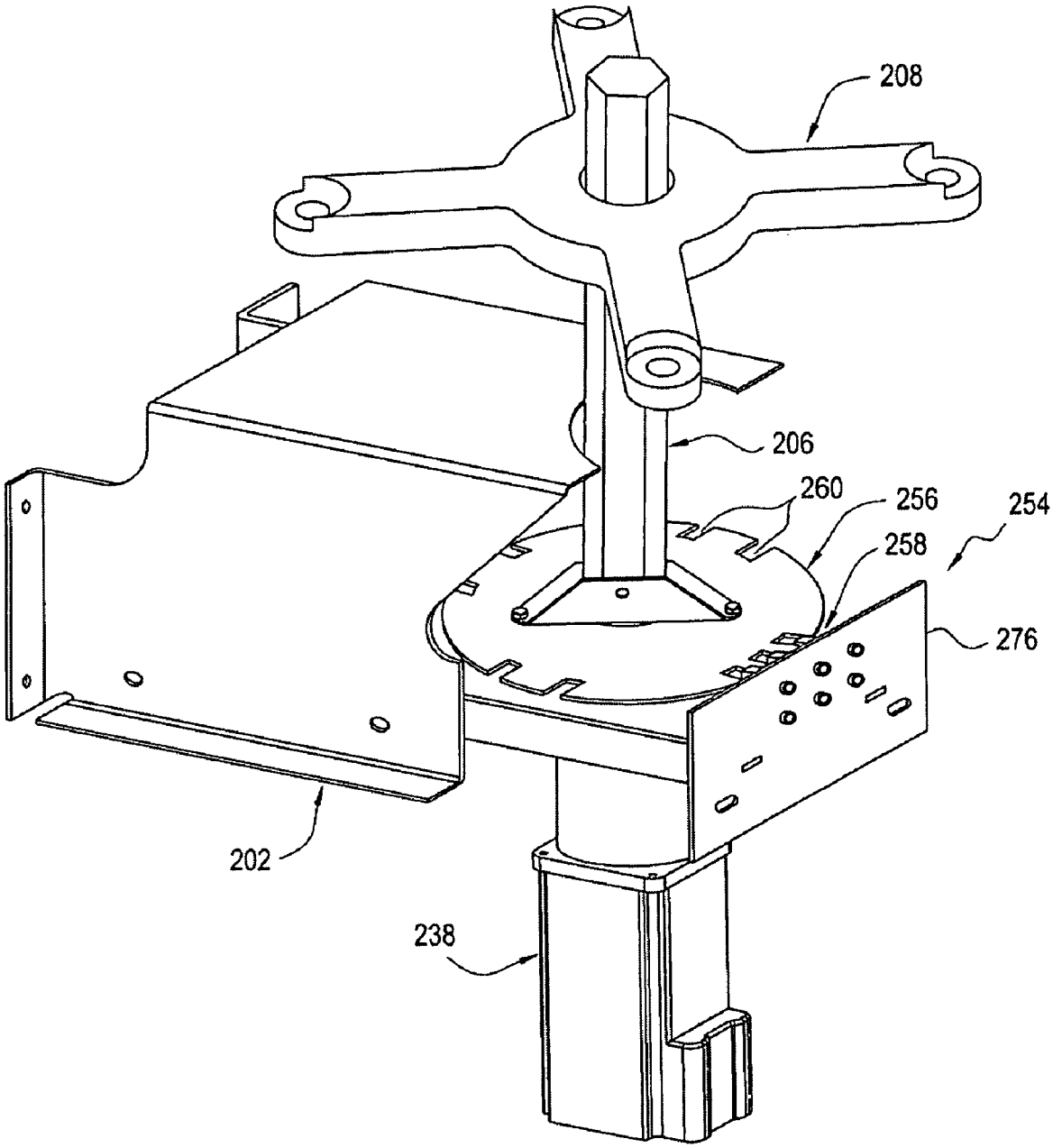
FIG. 37 is a perspective view of a column position sensor of the display system according to the present invention.

Referring now additionally to FIGS. 31-33, engagement between the display members 210 and the display engagement member 208 and display guide member 212 is now described in greater detail. Each of the plurality of display members 210 may comprise at least one pin member 226 to engage the display engagement member 208. Each display member 210 preferably includes a first pin member 270 and a second pin member 272. The first pin member 270 preferably engages the first display engagement member 232 and the second pin member 272 preferably engages the second display engagement member 234.

The pair of pin members 270, 272 advantageously increases stability of each of the display members 210 during rotation of the columns 204. The pin members 270, 272 are preferably connected to and extend outwardly from end portions of the display members 210. In other words, the first pin member 270 extends upwardly from an upper end portion 228 of the display member 210 to engage the first display engagement member 232, and the second pin member 272 extends downwardly from a lower end portion 230 of the display member to engage the second display engagement member 234.

Each of the display members 210 may also include a guide engagement member 236. The guide engagement member 236 is positioned adjacent the bottom portion 230 of the display member 210 to engage the arcuate shaped guide 214 in the display guide member 212. The guide engagement member 236 preferably has a cylindrical shape to engage the arcuate shaped guide 214. More specifically, the guide engagement member 236 may be a roller, i.e., the cylindrically shaped guide engagement member may spin when the column 204 rotates and the guide engagement member travels within the arcuate shaped guide 214.

As discussed in detail above, the columns 204 are four-sided rotatable columns. Accordingly, as the columns 204 rotate, four different display faces may be displayed by the display system 200. The columns 204 rotate between first, second, third and fourth display positions, each of the four different display positions being associated with a different display face. To move between each of the four different display faces, each column 204 preferably rotates 90 degrees. Four different display faces advantageously enhance the number of displays that may be shown on by the display system 200. When used in advertising applications, four different display faces advantageously enhance advertising revenue that may be generated by the display system 200.

The display system 200 includes a plurality of drives 238 to rotate the columns 204. More specifically, one drive 238 is associated with each column 204. Accordingly, the plurality of drives 238 advantageously allows each column 204 to individually rotate. Each of the drives 238 are preferably variable speed drives, but those having skill in the art will appreciate that any type of drives may be used to accomplish the goals of the present invention. Individual drives 238 for each of the columns 204 advantageously allow each of the columns to independently rotate. Further, the individual drives 238 also advantageously decrease maintenance associated with the display system 200. For example, if one column 204 fails, the remaining columns will continue to rotate. Each individual drive 238 has less of a load associated therewith then one drive for multiple columns 204. This advantageously increases the life of each drive.

As illustrated in FIG. 28, the display system also preferably includes a controller 240. For clarity, the controller 240 is illustrated schematically as being positioned outside the frame 202, but those skilled in the art will appreciate that the controller is carried within the frame so as not to be exposed to environmental elements. Each of the drives 238 are positioned in communication with the controller 240. Accordingly, each of the drives 238 are also positioned in communication with one another. The controller 240 is advantageously programmable to allow for any number of patterns of rotation of all of the columns 204 in the display system 200. For example, the controller 240 may be programmed to provide for rotation of each of the columns 204 between preselected display faces, i.e., between the first display face and the third display face. This advantageously allows a user to customize rotation of the columns 204 of the display system 200.

Those skilled in the art will appreciate that the columns 204 may be rotated individually or as a plurality. Further, each column 204 may be rotated in any desired direction and in any desired sequence. For example, when rotating a plurality of columns 204, the columns may be rotated in a wave formation, wherein sequential columns are slightly delayed in rotation to create a wave rotation. Further, columns 204 may be rotated in any sequence desired, i.e., only between the first and fourth positions, only between the first, second and fourth positions, etc. The versatility of independently rotating each of the columns 204 advantageously allow any number of different display themes to be provide, from as simple as one stationary display face to an animation using multiple display faces.

Referring now additionally to FIGS. 31-36, connection of media 274 to the display faces of the display members 210 is now described in greater detail. The media 274 may be provided by printable polyvinyl chloride (PVC) material. More particularly, the PVC material is preferably flexible enough to be transported in rolls. The PVC material is also preferably rugged, flexible and thin. Those skilled in the art will appreciate that the media 274 may also be provided by any type of laminate, for example, or any other type of material suitable for printing.

Those skilled in the art will also appreciate that the media 274 may also be printed paper material having a somewhat heavy weight. The paper material is preferably coated without provide some protection to environmental elements. The coating, however, is not intended to completely protect the media 274 from the environmental elements, but rather to merely slow down any erosion.

In a typical application, the plurality of media rolls is necessary to complete one display face, i.e., one side of all of the columns 204. Further, at least a pair of media rolls is generally necessary for each display face and for each column 204. Therefore, on a typical four-sided column 204 that includes four display faces, eight media rolls are used to fill each display face.

The media rolls may be printed individually. This advantageously enhances the cost effectiveness of printing the media 274 to be positioned on the faces of the display system 200. This can be accomplished using a printer through which the media 274 can be fed through. As the media 274 is fed through the printer, desired indicia is printed thereon. It is preferably that a printing system be used that allows the indicia to rapidly dry. Accordingly, the medial rolls may be rolled after the indicia is printed thereon, and rapidly transported to the display system 200 for installation thereon. Those having skill in the art will appreciate, however, that the media 274 may be printed as a large sheet and cut into individual display faces that can then be rolled for transport to and installation on the display system 200.

Each of the display members 210 may include media fastening members 246 connected thereto. More particularly, each display member 210 preferably includes a base media fastening member 248, a top media fastening member 250 and a pair of opposing side media fastening members 252. The media fastening members 246 may, for example, be integrally formed with the display members 210 to be a monolithic unit. Further, the media fastening members 246 may, for example, be lip members that extend outwardly from a surface portion of the display members 210.

Those skilled in the art will appreciate that the media fastening members 246 may be separate from the display members 210 and, accordingly, may be connected to the display members by any number of connection means. For example, the media fastening members 246 may be adhesively connected to portions of the display members 210 or may be welded to portions of the display members, or any other type of connection that may be suitable for fastening the media 274 to the display members. Those skilled in the art will also appreciate that the media fastening members 246 may be made of any number of materials.

The laminate media rolls may be brought to the site of the display system 200 and advantageously readily installed onto each display member 210. The laminate media rolls may, for example, be referred to as slide-up media. The term slide-up media may be used because an installer may slide the media up the display member 210 while the display member is installed on the frame 202 of the display system 200. Accordingly there is no need to disconnect the display members 210 from the frame 202 of the display system 200 in order to install the media roll.

The installer may advantageously engage edge portions of the media 274 with the media fastening members 246 and slide the media up each display member 210. As the media 274 slides up the display member 210, the edges of the media are held in place by the opposing side media fastening members 252. As an upper portion of the media 274 engages the top media fastening member 250, the bottom portion of the media may be positioned to engage the base media fastening member 248, thereby causing the media to be maintained in place along the display member 210.

Referring now additionally to FIGS. 37-42, column position sensors 254 of the display system 200 are now described in greater detail. Each of the rotatable columns 204 preferably includes a column position sensor 254 associated therewith. One column position sensor 254 is preferably positioned to overlie each of the drives 238. Those skilled in the art, however, will appreciate that the column position sensor 254 may be positioned anywhere along the column 204 and still achieve the goals and objectives of the present invention.

The column position sensor 254 is preferably positioned adjacent a lower portion of each column 204, but may also be positioned adjacent an upper portion of the column. Those skilled in the art will appreciate that it is preferably for the column position sensor 254 to be positioned adjacent each of the drives 238. Accordingly, although the drives 238 are illustrated as being positioned adjacent a lower portion of the columns 204, it should be recognized by those skilled in the art that the drives may also be positioned adjacent an upper portion of the columns.

Each column position sensor 254 preferably includes a control panel 274, and each control panel is in communication with the controller 240. Each column position sensor 254 includes a column position disk 256 carried by the respective column connection member 206 and a column position magnet 258 in communication with the column position disk. The column position magnet 258 is also in communication with the control panel 276. The control panel 274 may, for example, be provided by a printed circuit board (PCB) that is adapted to receive, transmit and carry out commands from the controller 240.

The column position magnet 254 may, for example, include a digital vane sensor. The digital vane sensor preferably detects the present of, absence of or change in a magnetic field. More specifically, the vane sensor may be mounted in close proximity to the column position magnet 258. A ferrous material, such as may be provided by the column position disk 256 may interrupt the magnetic field. An infrared optical sensor, or an optical encoder, for example, may also be used. The magnetic sensor is preferably, however, as it is more likely to withstand environmental factors, i.e., wind, rain, heat, dirt, oil, etc.

The printed circuit board (PCB) may also act as an interface between the digital vane sensor, each respective drive motor 238 and the controller 240. For example, the controller 240 may address each drive motor 238 individually, in small groups or collectively. The drive motors 238 and the PCB's are preferably wired together in series and to the controller 240. More specifically the drive motors 238 and PCB's are wired together in a daisy chain configuration. This configuration advantageously allows the controller 240 to address a drive motor 238 at the end of the chain by simply passing a signal through all the previous PCB's. This advantageously decreases the number of wires necessary to place all of the columns 204 in communication with one another.

Figure 38:
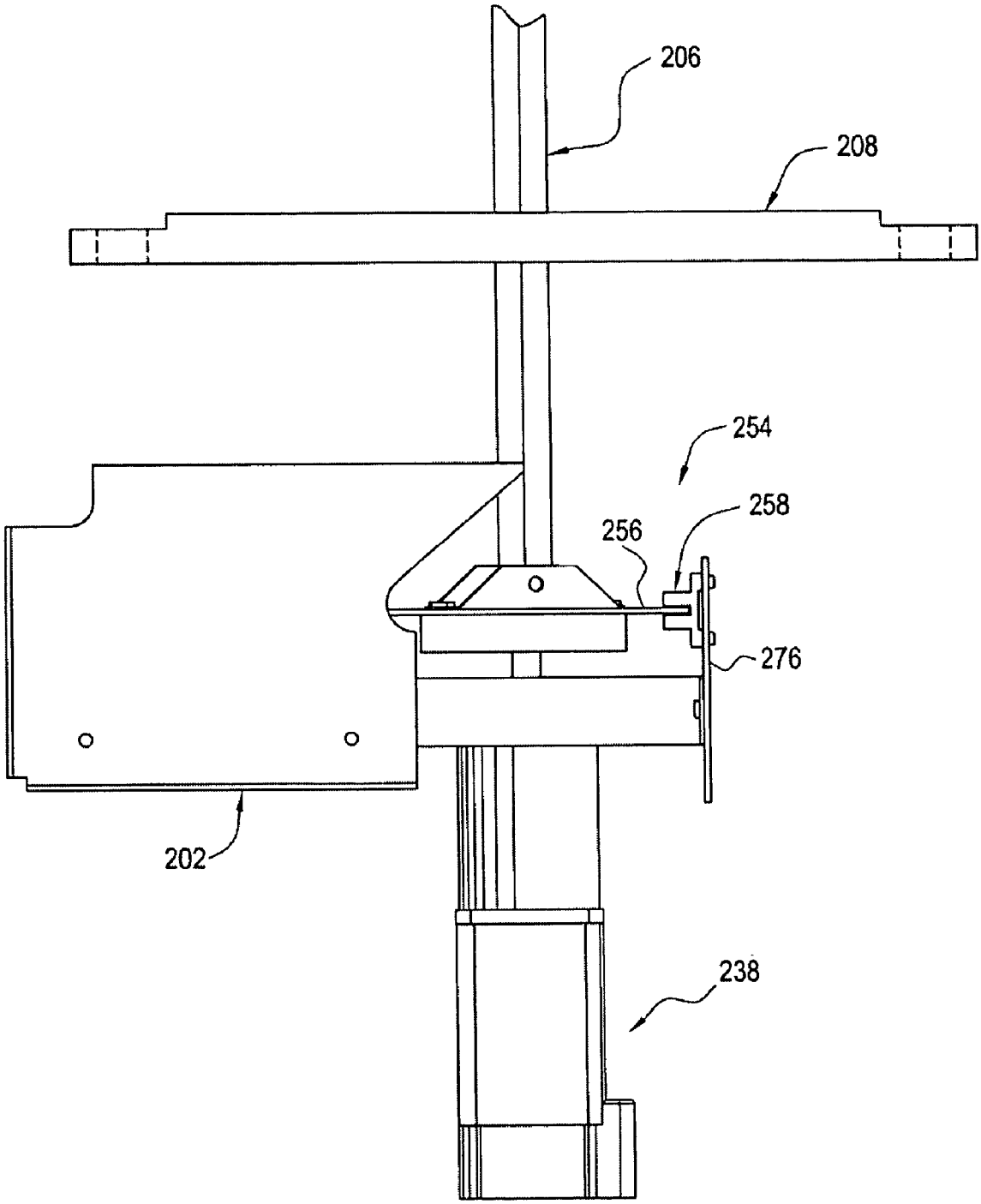
FIG. 38 is a side elevation view of the column position sensor illustrated in FIG. 37.

As perhaps best illustrated in FIG. 38, the column position magnet 258 comprises a series of spaced apart and opposing magnets. The column position disk 256 passes through the space between the opposing magnets as the columns 204 rotate. As illustrated in FIGS. 39-42, the column position disks 256 each include a plurality of column position indicators 260 that are spaced apart throughout the circumference of the disk. The column position indicators 260 indicate the position of each of the rotatable columns 204.

Figure 39:
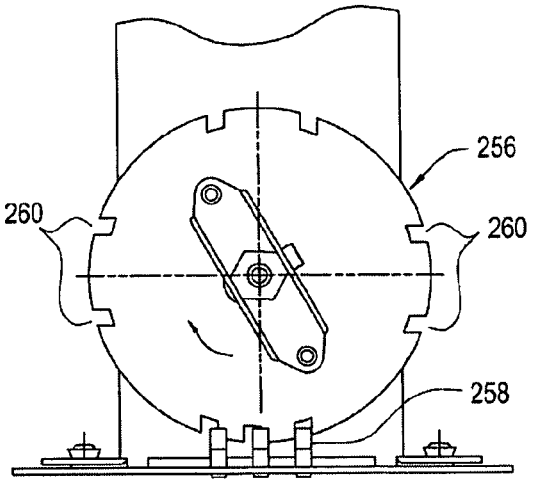
FIGS. 39-42 are top plan views of the column position sensor illustrated in FIG. 37 being rotated between first, second, third and fourth positions.
Figure 40:
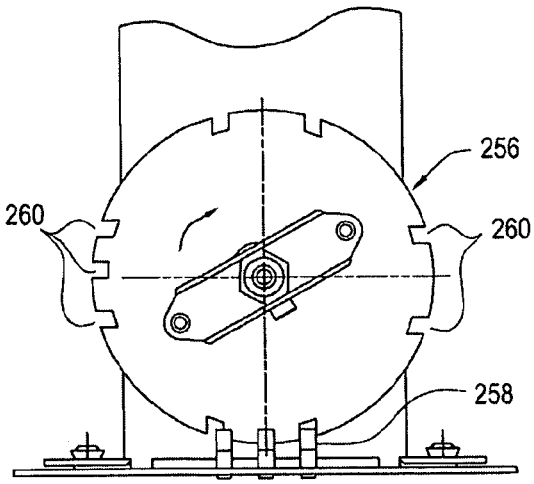
Figure 41:
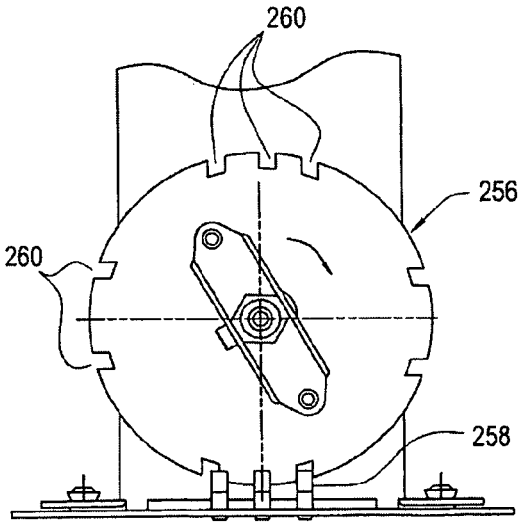
Figure 42:
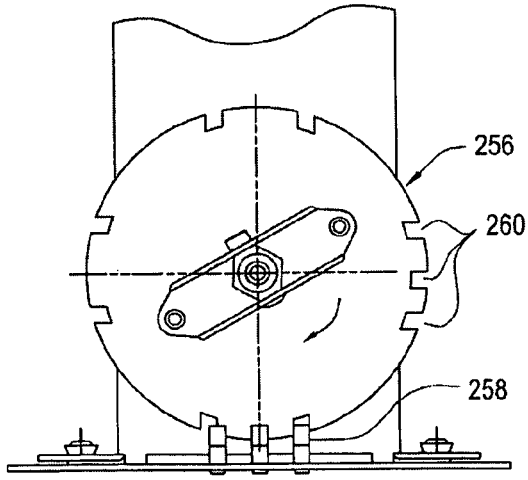

As the column position magnets 258 sense the column position indicators 260, the column position magnets communicate that position to the controller 240. The column position indicators 260 may, for example, be provided by a series of cutaway portions in the column position disk 256. For example, and as illustrated in FIG. 39, the first display position of the rotatable column 204 may be indicated using three cutaway portions. FIG. 40 illustrates the column position disk 256 being positioned in another position, e.g., the position corresponding to the second display face. Similarly, FIGS. 41 and 42 illustrate alternate positions of the rotatable column 204, e.g., third and fourth display positions.

As illustrated in FIGS. 39-42, the column position indicators 260 on the column position disks 256 preferably have one pattern for the first, or home, display face, and a second pattern for the second, third and fourth display faces. The first pattern may be three cutaway portions, corresponding to the three pairs of spaced apart column position magnets 258. Those skilled in the art will appreciate that the column position sensor 254 may include any number of column position magnets 258 and the column position indicators 260 may include any number of cutaway portions.

The number of cutaway portions of the column position indicator 260 in the first position may illustratively correspond to the number of pairs of magnets associated with the column position magnet 258. Those skilled in the art, however, will appreciate that any number of column position indicators 260 may be provided. For example, the second, third and fourth column position indicators 260 are illustratively provided using cutaways numbering less than the number of spaced apart magnets on the column position magnet 258.

The column position magnet 258 senses the space provided by the cutaway portions to indicate the position of the rotatable column 204. For example, the column position magnet 258 senses the pattern of spaces in the column position indicators 260 when in the first position to determine the location of the home position. This is especially advantageous in a case where one of the rotatable columns 204 becomes misaligned. In such a case, the column position sensor 254 provides an indication via the controller 240 that the rotatable column 204 that it is associated with has become misaligned. Thereafter, the column position sensor 254 may provide an indication, i.e., a command via a signal, to the drive 238 to rotate the column 204 back to the home position and wait to align with the remaining columns in order to continue rotation.

Such an arrangement becomes especially advantageous with respect to maintenance costs. In other words, when a column 204 becomes misaligned, the column position sensor 254 may automatically move the rotatable column back into alignment with the remaining columns. There is no need for human intervention, i.e., no need for a maintenance person to travel to the site to realign the column.

Figure 45:
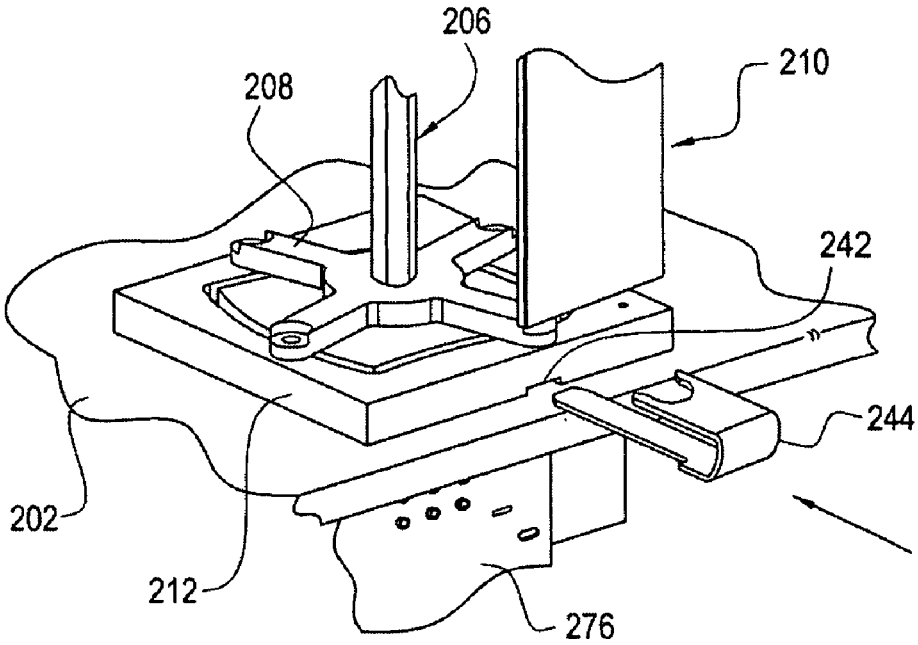
FIG. 45 is an exploded partial perspective view of a rotatable column of the display system according to the present invention showing a display guide member having a tool receiving recess formed therein and a tool to maintain a position of the rotatable column.
Figure 46:
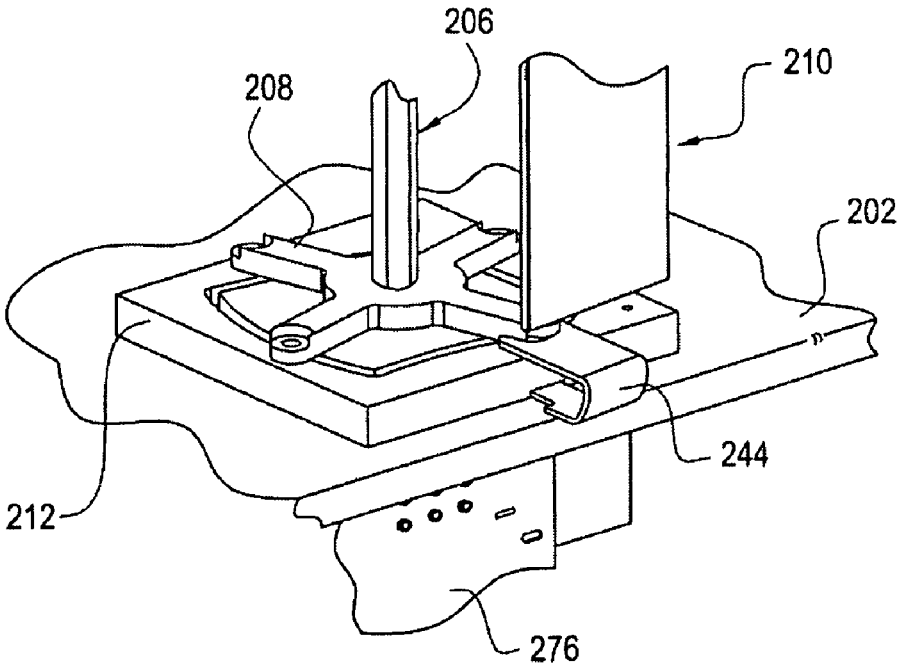
FIG. 46 is a partial perspective view of the rotatable column illustrated in FIG. 45 showing the tool engaging the tool receiving recess formed in the display guide member.

Referring now additionally to FIGS. 45 and 46, additional aspects of the display system 200 according to the present invention are now described in greater detail. Each of the display guide members 212 may include a tool receiving recess 242 for receiving a tool 244 to maintain a position of each of the respective plurality of rotatable columns 204. The tool receiving recess 242 may be a slot formed in a bottom portion of the display guide member 212.

The tool 244 illustratively has a U-shape so that a first portion may extend within the tool receiving recess 242 and a second portion may engage a portion of the display engagement member 208. More specifically, the second portion of the tool 244 that engages the display engagement member 208 may have a curved shape to engage a curved end of the display engagement member. The tool 244 advantageously prevents the column 204 from rotating so that maintenance may be performed.

The tool 244 also advantageously provides a more precise position adjustment after maintenance on a column 204 has been completed, or after installation of a drive assembly, for example. More specifically, the tool 244 may engage a portion of the display engagement member 208 to lock the column 204 in a proper flat viewing position. Bolts that secure the PCB and the vane sensor assembly in place may then be slightly loosened. Thereafter, minor adjustments can be made until a PCB provides an indication of a proper home position of the column 204. This indication may, for example, be provided by an illumination, or any other type of indication. After the indication of the proper home position is received, the bolts securing the PCB and the vane sensor may then be tightened, and the tool 244 may be removed.

For example, the column 204 may be prevented from rotation while the display members 210 are being connected and/or disconnected from the display engagement member 208. Another example of a time when the tool 244 may be used to prevent rotation of the column 204 is when the media 274 is being connected to the display members 210. Those skilled in the art will appreciate that there are several times when it may be advantageous for the tool 244 to be used to prevent rotation of the columns 204.

A method aspect of the present is for displaying indicia. The method may include positioning the indicia on a plurality of rotatable columns 204 carried by the frame 202. The method may also include engaging the respective plurality of rotatable columns 204 to the respective plurality of display guide members 212 carried by the frame 202. The method may further include rotating the rotatable columns 204 having the indicia positioned thereon.

Another method aspect of the present invention is for creating a simulation of an appearance of each display face on the display system prior to printing media to be affixed to the media fastening members on each of the columns. The method preferably includes uploading an image to be displayed on a display face and sizing the image to fit on a desired display face. The size of the image to be positioned on the display face will, of course, be dependent upon the size of the display face. For example, different display systems may have different sized display faces. Accordingly, the image to be positioned on the display face must be sized to properly fit on the display face.

The method may also include uploading additional images to be displayed on each additional display face of the display system. Again, each display image may be sized to fit on a desired display face. After the images to be displayed on the display faces are uploaded, the user may simulate rotation of each of the columns to thereby simulate movement between the first, second, third and fourth display faces. The method still further includes animating column rotation to create different visual effects using rotation of each of the columns.

The method is carried out using a software system. More specifically, the software system may be stored on a readable medium to be read by a computer, or may be downloaded using a global communications network and installed on a user's computer. The system preferably allows a user to upload the multiple images to be displayed on the display system 200.

The system may include a board setup component and a display setup component. The board setup component may allow the user to upload images to be displayed each display face, and may also allow the user to specify the size of the image. For example, if a particular display system includes 52 columns, the image is preferably split into 104 individual sections, as each column includes 8 display members, 2 per display face. The board setup component also allows a user to specify the height of each column, and well as the width of each column. Those skilled in the art will appreciate that each display system may have different dimensions and, accordingly, require that indicia and media to be positioned on the display system be properly sized.

The board setup component of the system also advantageously allows the user to specify the turn time of the column members, i.e., the time it takes for the column member to turn from one position to an adjacent position. The board setup component of the system further advantageously allows a user to specify spacing between each column. All of these dimensions and customizable inputs advantageously allow a user to provide a more accurate simulation of the display system. This also advantageously allows a user to save money in the form of startup costs that may be associated with designing the media and indicia to be displayed on the display system. Further, the user can advantageously test various ideas to be displayed.

The display setup component advantageously allows a user to customize the appearance of the display system as the display faces turn from one face to another. It is through the display system component that a user may select certain faces to be displayed, or may chose the manner in which the faces are displayed.

For example, a user may desire the plurality of columns to rotate on a delay from left to right, from right to left, from the center out to the edges, or from the edges into the center. All of these different variations, among many others, are possible using the display setup component of the system. In other words, this aspect of the display setup component advantageously allows a user to customize the manner in which the plurality of columns are rotated.

The display setup component of the system also advantageously allows a user to control display time of each display face. For example, it may be desirable to provide one of the plurality of faces with more display time than another of the plurality of faces. Accordingly, the display setup component of the system allows a user to customize the manner in which multiple display faces are displayed.

The system also advantageously allows users to simulate motion of the display system so as to decrease any trial and error that may be associated with implementing a desired display pattern while on site. For example, a user may desire to display a first display face, provide an animation in rotation from the first display face to the second display face and rotate the columns in a delay animation from right to left from the second display face to the third display face. This can be performed using the system and, once perfected on the system, can be incorporated into the display system for rotation of each of the columns. More specifically, the system, i.e., the software, may also be installed on the display system and in communication with the controller.

A file having the specific rotation sequences and other customizable features may be saved and transferred to the software on the sign so that the sign may run the finalized simulation. Accordingly, the file may be transferred, i.e., uploaded, directly to the software on the sign so that the program may be run on the sign without any further steps. Those skilled in the art will appreciate that the file may be transferred in any number of ways such as, for example, upload via a global communications network, transfer via a disk on site, transfer by connecting a portable device to the controller, or any number of different ways known to transfer data in a file.

Those skilled in the art will appreciate that the system may be used on any type of display system having rotatable columns. For example, the system may be used to provide simulations for three sided rotatable display systems, as well as four-sided rotatable display systems. More specifically, those skilled in the art will appreciate that the features and advantages of the above referenced system may be applied to any type of display system.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A display system comprising:

a frame;

at least one rotatable columns carried by said frame, said at least one rotatable column comprising a column connection member, at least one display engagement member carried by said column connection member, and a plurality of display members carried by said at least one display engagement member, and at least one display guide member carried by said frame to engage said at least one rotatable column;

wherein said at least one display guide member includes an arcuate shaped guide, wherein said at least one display guide member four imaginary quadrants, wherein a portion of the arcuate shaped guide extends through each of the four imaginary quadrants, and wherein each portion of the arcuate shaped guide extending through each of the imaginary quadrant has a different shape.

2. A display system according to claim 1 wherein the arcuate shaped guide is defined by an arcuate shaped slot formed in each of the plurality of display guide members.

3. A display system according to claim 1 wherein each of said plurality of display members comprises at least one pin member extending from at least one of a top portion and a bottom portion thereof to engage said at least one display engagement member.

4. A display system according to claim 1 wherein said at least one display engagement member comprises a first display engagement member carried by an upper portion of said column connection member and a second display engagement member carried by a lower portion of said column connection member.

5. A display system according to claim 1 wherein each of said plurality of display members comprises at least one guide engagement member to engage the arcuate shaped guide.

6. A display system according to claim 1 wherein said at least one rotatable column is a four-sided rotatable column.

7. A display system according to claim 1 wherein said plurality of display members comprises four display members.

8. A display system according to claim 1 wherein said at least one rotatable column rotates between first, second, third and fourth positions; and wherein said at least one rotatable column rotates 90 degrees to move between the first, second, third and fourth positions.

9. A display system according to claim 1 further comprising at least one drive for rotating said at least one rotatable column.

10. A display system according to claim 9 further comprising at least one controller in communication with said at least one drive.

11. A display system according to claim 10 wherein said at least one drive is at least one variable speed drive.

12. A display system according to claim 1 wherein said at least one display guide member comprises a tool receiving recess for receiving a tool to maintain a position of said at least one rotatable column.

13. A display system according to claim 1 wherein each of said display members comprises at least one media fastening member connected thereto.

14. A display system according to claim 13 wherein the at least one media fastening member comprises a base media fastening member, a top media fastening member and a pair of opposing side media fastening members.

15. A display system according to claim 10 further comprising at least one column position sensor associated with said at least one rotatable column, said at least one column position sensor positioned in communication with said controller.

16. A display system according to claim 15 wherein said at least one column position sensor comprises a column position disk carried by said respective column connection member, and a column position magnet in communication with said column position disk.

17. A display system according to claim 16 wherein said column position disk includes a plurality of column position indicators to indicate a position of said at least one rotatable column, and wherein each of said column position magnets is in communication with said controller to transmit a position of said at least one rotatable column based on a sensed position of the plurality of column position indicators.

18. A display system comprising:

a frame;

a plurality of rotatable columns carried by said frame, each of said plurality of rotatable columns comprising a column connection member, at least one display engagement member carried by said column connection member, and a plurality of display members carried by said at least one display engagement member, and a respective plurality of display guide members carried by said frame to engage each of said plurality of rotatable columns; and a respective plurality of drives for rotating each of the respective plurality of rotatable columns, wherein each of the respective plurality of rotatable columns comprises at least one drive associated therewith;

at least one controller in communication with each of the plurality of drives so that each of the respective plurality of drives are in communication with one another; and a respective plurality of column position sensors associated with the respective plurality of rotatable columns, each column position sensor positioned in communication with said controller;

wherein each of said respective plurality of column position sensors comprises a column position disk carried by said respective column connection member, and a column position magnet in communication with said respective column position disk.

19. A display system according to claim 18 wherein each of said plurality of rotatable columns has four sides, and each of said respective plurality of display guide members includes an arcuate shaped guide, wherein each display guide member has four imaginary quadrants, wherein a portion of the arcuate shaped guide extends through each of the four imaginary quadrants, and wherein each portion of the arcuate shaped guide extending through each of the imaginary quadrant has a different shape.

20. A display system according to claim 19 wherein the arcuate shaped guide is defined by an arcuate shaped slot formed in each of the plurality of display guide members.

21. A display system according to claim 18 wherein each of said plurality of display members comprises at least one pin member extending from at least one of a top portion and a bottom portion thereof to engage said at least one display engagement member.

22. A display system according to claim 18 wherein said at least one display engagement member comprises a first display engagement member carried by an upper portion of said column connection member and a second display engagement member carried by a lower portion of said column connection member.

23. A display system according to claim 19 wherein each of said plurality of display members comprises at least one guide engagement member to engage the arcuate shaped guide.

24. A display system according to claim 18 wherein each of the display guide members further comprises a tool receiving recess for receiving a tool to maintain a position of the respective rotatable column.

25. A display system according to claim 18 wherein each of said column position disks includes a plurality of column position indicators to indicate a position of each of said rotatable columns, and wherein each of said column position magnets is in communication with said controller to transmit a position of each of said plurality of rotatable columns based on a sensed position of the plurality of column position indicators.

26. A display system comprising:

a frame;

a plurality of four-sided rotatable columns carried by said frame, each of said plurality of rotatable columns comprising a column connection member, at least one display engagement member carried by said column connection member, and a plurality of display members carried by said at least one display engagement member, and a respective plurality of display guide members carried by said frame to engage each of said plurality of rotatable columns;

wherein each of said respective plurality of display members comprises at least one pin member extending through at least one of a top portion and a bottom portion thereof to engage said at least one display engagement member;

a controller in communication with each of said plurality of foursided rotatable columns; and a respective plurality of column position sensors positioned in communication with said controller, each column position sensor comprising a column position disk carried by said respective column connection member, and a column position magnet in communication with said respective column position disk.

27. A display system according to claim 26 wherein each of said respective plurality of display guide members includes an arcuate shaped guide, wherein each display guide member has four imaginary quadrants, wherein a portion of the arcuate shaped guide extends through each of the four imaginary quadrants, and wherein each portion of the arcuate shaped guide extending through each of the imaginary quadrant has a different shape.

28. A display system according to claim 27 wherein the arcuate shaped guide is defined by an arcuate shaped slot formed in each of the plurality of display guide members.

29. A display system according to claim 26 wherein said at least one display engagement member comprises a first display engagement member carried by an upper portion of said column connection member and a second display engagement member carried by a lower portion of said column connection member.

30. A display system according to claim 27 wherein each of said plurality of display members comprises at least one guide engagement member to engage the arcuate shaped guide.

31. A display system according to claim 26 further comprising a respective plurality of drives in communication with said controller for rotating each of the respective plurality of rotatable columns, wherein each of the respective plurality of rotatable columns comprises at least one drive associated therewith.

32. A display system according to claim 31 wherein each of the respective plurality of drives are variable speed drives.

33. A display system according to claim 26 wherein each of said display guide members comprises a tool receiving recess for receiving a tool to maintain a position of each of said respective plurality of rotatable columns.

34. A display system according to claim 26 wherein each of said column position disks includes a plurality of column position indicators to indicate a position of each of said rotatable columns, and wherein each of said column position magnets is in communication with said controller to transmit a position of each of said plurality of rotatable columns based on a sensed position of the plurality of column position indicators.

35. A method of displaying indicia, the method comprising:

positioning the indicia on a plurality of rotatable columns carried by a frame, each of the respective plurality of rotatable columns comprising a column connection member, at least one display engagement member carried by the column connection member, and the plurality of display members carried by the at least one display engagement member, the indicia being carried by the plurality of display members;

engaging the respective plurality of rotatable columns to a respective plurality of display guide members carried by the frame; and rotating the rotatable columns having the indicia positioned thereon;

wherein each of the respective plurality of display guide members includes an arcuate shaped guide, wherein each display guide member has four imaginary quadrants, wherein a portion of the arcuate shaped guide extends through each of the four imaginary quadrants, and wherein each portion of the arcuate shaped guide extending through each of the imaginary quadrant has a different shape.

36. A method according to claim 35 wherein the arcuate shaped guide is defined by an arcuate shaped slot formed in each of the plurality of display guide members.

37. A method according to claim 35 wherein each of the plurality of display members comprises at least one pin member extending through at least one of a top portion and a bottom portion thereof to engage the at least one display engagement member.

38. A method according to claim 35 wherein the at least one display engagement member comprises a first display engagement member carried by an upper portion of the column connection member and a second display engagement member carried by a lower portion of the column connection member.

39. A method according to claim 35 wherein each of the plurality of display members comprises at least one guide engagement member to engage the arcuate shaped guide.

40. A method according to claim 35 wherein each of the plurality of rotatable columns are four-sided rotatable columns; and wherein the plurality of display members comprises four display members; and wherein the rotatable columns rotate between first, second, third and fourth positions; and wherein the rotatable columns rotate 90 degrees to move between the first, second, third and fourth positions.

41. A method according to claim 35 further comprising a respective plurality of drives for rotating each of the respective plurality of rotatable columns, wherein each of the respective plurality of columns comprises at least one drive associated therewith.

42. A method according to claim 41 further comprising at least one controller in communication with each of the plurality of drives so that each of the respective plurality of drives are in communication with one another.

43. A method according to claim 41 wherein each of the plurality of drives are variable speed drives.

44. A method according to claim 35 wherein each of the display guide members comprises a tool receiving recess for receiving a tool to maintain a position of each of the respective plurality of rotatable columns.

45. A method according to claim 35 wherein each of the display members comprises at least one media fastening member connected thereto; and wherein the at least one media fastening member comprises a base media fastening member, a top media fastening member and a pair of opposing side media fastening members.

46. A method according to claim 42 further comprising using a respective plurality of column position sensors in communication with the controller to sense a rotational position of each of the plurality of columns.

47. A method according to claim 46 wherein each of the respective plurality of column position sensors comprises a column position disk carried by said respective column connection member, and a column position magnet in communication with said respective column position disk.

48. A method according to claim 47 wherein each of the column position disks includes a plurality of column position indicators to indicate a position of each of the rotatable columns, and wherein each of the column position magnets is in communication with the controller to transmit a position of each of the plurality of rotatable columns based on a sensed position of the plurality of column position indicators.

* * * * *